US008983353B2

(12) United States Patent
Yoshiura et al.

(10) Patent No.: US 8,983,353 B2
(45) Date of Patent: Mar. 17, 2015

(54) FIXING APPARATUS AND IMAGE FORMING APPARATUS

(75) Inventors: Arinobu Yoshiura, Kanagawa (JP); Masaaki Yoshikawa, Tokyo (JP); Yuji Arai, Kanagawa (JP); Yoshiki Yamaguchi, Kanagawa (JP); Tetsuo Tokuda, Kanagawa (JP); Yutaka Ikebuchi, Kanagawa (JP); Toshihiko Shimokawa, Kanagawa (JP); Kenji Ishii, Kanagawa (JP); Hiroshi Yoshinaga, Chiba (JP); Hiromasa Takagi, Tokyo (JP); Naoki Iwaya, Tokyo (JP); Takuya Seshita, Kanagawa (JP); Takahiro Imada, Kanagawa (JP); Hajime Gotoh, Kanagawa (JP); Ippei Fujimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/993,229

(22) PCT Filed: Nov. 22, 2011

(86) PCT No.: PCT/JP2011/077452

§ 371 (c)(1),
(2), (4) Date: Jun. 11, 2013

(87) PCT Pub. No.: WO2012/081388

PCT Pub. Date: Jun. 21, 2012

(65) Prior Publication Data

US 2013/0266355 A1 Oct. 10, 2013

(30) Foreign Application Priority Data

Dec. 14, 2010 (JP) ..... 2010-278149

(51) Int. Cl.
*G03G 15/20* (2006.01)

(52) U.S. Cl.
CPC ..... *G03G 15/2085* (2013.01); *G03G 15/2017* (2013.01); *G03G 15/2064* (2013.01); *G03G 2215/2035* (2013.01)
USPC ..... 399/329; 399/328

(58) Field of Classification Search
None
See application file for complete search history.

(56) References Cited

U.S. PATENT DOCUMENTS 5,525,775 A 6/1996 Setoriyama et al.
5,621,512 A 4/1997 Uehara et al.

(Continued)

FOREIGN PATENT DOCUMENTS

JP 04-044075 2/1992
JP 06-314041 11/1994

(Continued)

OTHER PUBLICATIONS

International Search Report Issued Dec. 27, 2011 in PCT/JP2011/077452 Filed on Nov. 22, 2011.

*Primary Examiner* — Clayton E Laballe
*Assistant Examiner* — Jas Sanghera
(74) *Attorney, Agent, or Firm* — Oblon, McClelland, Maier & Neustadt, L.L.P.

(57) ABSTRACT

A fixing apparatus includes: a fixing belt; a pressurizing roller; a supporting member; a heating unit; a nip forming member; and a deform preventing unit. The fixing apparatus and an image forming apparatus including the fixing apparatus prevent a supporting member from deforming due to sliding of a fixing member, improving energy conservation and durability of parts and obtaining a good image.

21 Claims, 15 Drawing Sheets

(56) References Cited

U.S. PATENT DOCUMENTS

| | | | | |
|---|---|---|---|---|
| 6,198,888 | B1 | 3/2001 | Kurotaka et al. | |
| 7,885,569 | B2 | 2/2011 | Kishi et al. | |
| 8,010,028 | B2 | 8/2011 | Shinshi | |
| 8,311,469 | B2 | 11/2012 | Yoshikawa et al. | |
| 8,364,052 | B2 | 1/2013 | Iwaya et al. | |
| 8,385,804 | B2 | 2/2013 | Yamaguchi et al. | |
| 8,401,414 | B2 | 3/2013 | Yoshikawa et al. | |
| 8,401,448 | B2 | 3/2013 | Yamaguchi et al. | |
| 8,428,502 | B2 | 4/2013 | Tokuda et al. | |
| 8,437,675 | B2 | 5/2013 | Ishii et al. | |
| 8,447,220 | B2 | 5/2013 | Yamaguchi et al. | |
| 8,463,168 | B2 | 6/2013 | Fujimoto et al. | |
| 2010/0092220 | A1 | 4/2010 | Hasegawa et al. | |
| 2010/0092221 | A1 | 4/2010 | Shinshi et al. | |
| 2010/0202809 | A1* | 8/2010 | Shinshi et al. | 399/329 |
| 2010/0290822 | A1 | 11/2010 | Hasegawa et al. | |
| 2010/0303521 | A1 | 12/2010 | Ogawa et al. | |
| 2011/0026987 | A1 | 2/2011 | Hasegawa | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064451 | A1 | 3/2011 | Yamaguchi et al. | |
| 2011/0064490 | A1 | 3/2011 | Imada et al. | |
| 2011/0064502 | A1 | 3/2011 | Hase et al. | |
| 2011/0076071 | A1 | 3/2011 | Yamaguchi et al. | |
| 2011/0085815 | A1 | 4/2011 | Kishi et al. | |
| 2011/0085832 | A1 | 4/2011 | Hasegawa et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0170917 | A1 | 7/2011 | Yoshikawa et al. | |
| 2011/0176822 | A1 | 7/2011 | Ishii et al. | |
| 2011/0182634 | A1 | 7/2011 | Ishigaya et al. | |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0211876 | A1 | 9/2011 | Iwaya et al. | |
| 2011/0217056 | A1 | 9/2011 | Yoshinaga et al. | |
| 2011/0217057 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222888 | A1 | 9/2011 | Ikebuchi et al. | |
| 2011/0222926 | A1 | 9/2011 | Ueno et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229178 | A1 | 9/2011 | Ogawa et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0274453 | A1 | 11/2011 | Shimokawa et al. | |
| 2011/0286758 | A1 | 11/2011 | Yoshinaga | |
| 2012/0051774 | A1 | 3/2012 | Ikebuchi et al. | |
| 2012/0114345 | A1 | 5/2012 | Fujimoto et al. | |
| 2012/0121304 | A1 | 5/2012 | Tokuda et al. | |
| 2012/0121305 | A1 | 5/2012 | Yoshikawa et al. | |

FOREIGN PATENT DOCUMENTS

| | | |
|---|---|---|
| JP | 08-262903 | 10/1996 |
| JP | 10-213984 | 8/1998 |
| JP | 11-002982 | 1/1999 |
| JP | 2007-334205 | 12/2007 |
| JP | 2010-096782 | 4/2010 |
| JP | 2011-028138 | 2/2011 |
| JP | 2012-103608 | 5/2012 |

* cited by examiner

FIXING APPARATUS AND IMAGE FORMING APPARATUS

TECHNICAL FIELD

The present invention relates to fixing apparatuses which fix a toner to a recording medium with heat and pressure and image forming apparatuses such as a facsimile machine, a printer, a copying machine, an equipment unit having these multiple functions, etc., using an electrophotographic scheme, an electrostatic recording scheme, etc., that include the fixing apparatuses.

BACKGROUND ART

As image forming apparatuses such as a copying machine, a printer, etc., various image forming apparatuses using an electrophotographic scheme have been devised, and have become well known in the art. An image forming process includes a process such that an electrostatic latent image is formed on a surface of a photoconductive drum, which is an image-bearing body; the electrostatic latent image on the photoconductive drum is developed by a toner, which is a developer, etc., to produce a visualized image; the developed image is transferred to a recording sheet with a transferring apparatus to bear the image thereon; and the toner image on the recording sheet is fixed with a fixing apparatus which uses pressure, heat, etc.

In this fixing apparatus, a pressurizing member and a fixing member that include opposing rollers or belts or a combination thereof abut against each other to form a nip portion; a recording sheet is put into the nip portion, and heat and pressure are applied to fix the toner image onto the recording sheet.

An example of the fixing apparatus includes a known technique which uses, as a fixing member, a fixing belt which is stretched by multiple roller members (for example, see Patent Document 1). Such an apparatus using the fixing belt includes a fixing belt (an endless belt) 204 as a fixing member, multiple roller members 202, 203 which stretch and support the fixing belt 204, a heater 201 which is installed inside the roller member 202 of the multiple roller members 202, 203, a pressurizing roller (a pressurizing member) 205, etc. (see FIG. 19). The heater heats the fixing belt 204 via the roller members 202, 203. Then, a toner image on a recording medium which is carried to a nip portion formed between the fixing belt 204 and the pressurizing roller 205 is fixed onto the recording medium with heat and pressure received at the nip portion (Belt fixing scheme).

Moreover, for a fixing apparatus for use in the above-described image forming apparatus, there is a fixing apparatus which includes a fixed member which slidingly contacts an inner face of a fixing member which is a rotor.

For example, Patent document 2 discloses a film-heating fixing apparatus, wherein a heat-resistant film (a fixing film) 213 is sandwiched between a ceramic heater 211 as a heating body and a pressurizing roller 212 as a pressurizing member to form a fixing nip portion N, and a recording material with an unfixed toner image to be fixed being formed and carried thereon is introduced between the pressurizing roller 212 and the film 213 of the fixing nip portion N and is caused to be sandwiched and carried with the film 213 therebetween, so that, in the nip portion N, heat of the ceramic heater 211 is provided to the recording material via the film 213 and pressurizing of the fixing nip portion N fixes the unfixed toner image onto a face of the recording material by heat and pressure (see FIG. 20). This type of film-heating fixing apparatus allows configuring an on-demand type apparatus using a low heat capacity material as a film and a ceramic heater and also allows powering on the ceramic heater as a heat source to be heated to a predetermined fixing temperature only when executing image formation of an image forming apparatus, so that there are advantages that a waiting time is short from when the power of the image forming apparatus is turned on to when image forming can be executed (Quick start), and power consumed at standby is significantly small (power conservation), etc.

Moreover, in Patent documents 3 and 4 is proposed a pressurizing-belt image fixing apparatus, including a rotatable heating fixing roller, a surface of which rotatable heating fixing roll elastically deforms; an endless belt (a pressurizing belt) which allows travelling while being in contact to the heating fixing roller and a belt nip which is non-rotatably arranged inside the endless belt to abut the endless belt against the heating fixing roll and through which a recording sheet is caused to pass between the endless belt and the heating fixing roller; and a pressurizing pad which elastically deforms the surface of the heating fixing roller. According to this fixing scheme, a lower pressurizing member is arranged to be a belt and a contact area between a sheet and a roller is widened, making it possible to drastically improve heat conduction efficiency, suppress energy consumption, and realize a reduced size.

However, with the above-described fixing apparatus of Patent document 1, which is suitable for an increased speed of the apparatus relative to an apparatus using a fixing roller, there are limitations on reducing warm-up time (time required to reach a temperature at which printing is possible) and first-print time (from the time at which a request for printing is received to the time at which sheet discharging is completed via print preparation and printing operations).

On the other hand, the fixing apparatus of Patent document 2 makes it possible to shorten the warm-up time and the first print time due to a lowered heat capacity and to realize an apparatus of a reduced size. However, the fixing apparatus of Patent document 2 has problems with durability and with belt temperature stability. In other words, phenomena occur such as abrasion which is due to sliding of an inner face of a belt; a ceramic heater which is insufficient as a heat source; operating for a long time causing a face on which continuous friction is repeated to become rough, so that frictional resistance increases and travelling of the belt becomes unstable, or driving torque of the fixing apparatus increasing, so that, as a result, slipping of a transfer sheet for forming an image occurs; or stress on a drive gear increases, causing a failure such that the gear is damaged (Problem 1).

Moreover, with the film-heating fixing apparatus, there is a problem that, as the belt is locally heated at the nip portion, the belt temperature becomes lowest when the rotating belt returns to a nip inlet, so that, especially when high-speed rotating is conducted, fixing failure is likely to occur (Problem 2).

On the other hand, Patent document 3 discloses measures of improving the problem of slidability between a fixed member and an inner face of a belt using a polytetra-fluoroethylene (PTFE) impregnated glass fiber sheet (PTFE impregnated glass cloth) as a low friction sheet-shaped sliding material on a surface layer of a pressure pad. However, with such a pressurizing-belt fixing apparatus (Patent documents 3 and 4), there is a problem that heat capacity of the fixing roller is large and temperature rise is slow, so that time required for warming up is long (Problem 3).

For the problems 1 to 3 as described above, Patent document 5 discloses a fixing apparatus, wherein generally pipe-shaped opposing members (a metal heat conductor, a heating member, a supporting member) arranged on the inner peripheral side of an endless fixing belt and a ceramic heater which is arranged on the inner peripheral side of the opposing members and which heats the opposing members are provided, making it possible to heat the whole fixing belt, shorten warm-up time and first-print time, and overcome a shortage of heat capacity at the time of high-speed rotation.

However, with the fixing apparatus of Patent document 5, the nip portion which is formed by pressing, onto the fixing belt side, a pressurizing roller which is a pressurizing member is supported by a metal heat conductor, a nip width and pressure in the nip portion becomes unstable.

Thus, in the Patent document 6 is proposed the feature of providing, in order to maintain the state, shape, position, etc., of a pipe-shaped supporting member and a nip portion with a pressurizing roller and a fixing belt, nip forming members (an abutting member, a fixed member) and a reinforcing member such that they correspond to a part at which the nip portion is formed.

PATENT DOCUMENTS

Patent document 1 JP11-2982A
Patent document 2 JP4-44075A
Patent Document 3 JP8-262903A
Patent Document 4 JP10-213984A
Patent Document 5 JP2007-334205A
Patent Document 6 JP2010-96782A However, as the supporting member is a thin metal pipe and has a concave portion for arranging nip forming members, when the fixing belt slides, load (stress) becomes concentrated at the concave portion to cause deforming of the supporting member, which deforming causes local overheating of the supporting member and slipping of the fixing belt, causing problems of decrease in energy conserved, decrease in durability of parts, and image quality anomalies.

SUMMARY OF THE INVENTION

Means for Solving the Problems

In view of the problems of the related art as described above, an object of the present invention is to provide a fixing apparatus which prevents a supporting member from being deformed due to sliding of a fixing member, which has an improved durability of components and energy conservation, and from which a good image is obtained.

The present invention which is provided in order to solve the above-described problem is as shown below. In parentheses are shown corresponding parts, letters, etc., in embodiments of the present invention.

(1) A fixing apparatus (a fixing apparatus 20, FIGS. 2 to 9, FIGS. 14 to 16), includes:

a fixing member (a fixing belt 21) for a rotatable endless belt;

a pressurizing member (a pressurizing roller 31) which is arranged to be abuttable against the fixing member on an outer peripheral side of the fixing member;

a supporting member (a supporting member 60) which is a C type pipe member and which has a concave portion (a nip concave portion 61) with an opening (an opening 69) thereof arranged to be a bottom face side, the C type pipe member being fixedly provided inside the fixing member and an outer peripheral face of the C type pipe member being in slidable contact with an inner peripheral face of the fixing member;

a heating unit (a heating unit 25) which heats the supporting member;

a nip forming member (a nip forming member 26) which is contained in a concave portion of the supporting member that is on an inner peripheral side of the fixing member, and which abuts against the pressurizing member via the fixing member to form a nip portion; and a deform preventing unit (an external holding member 70, an internal holding member 71) which reinforces the concave portion to prevent deforming of the supporting member due to sliding of the fixing member.

(2) The fixing apparatus as recited in (1) in the above (FIGS. 14 and 15B), wherein the deform preventing unit includes an internal holding member (an internal holding member 71) which has an L-shaped angle shape or which has a groove shape with a cross section which is U-shaped and lengths of both of which sleeve portions differ, the internal holding member being installed from an outer peripheral side of the supporting member to inside the concave portion, wherein when the internal holding member has the groove shape, an outer face of longer one (a sleeve portion $\mathbf{71}_{S1}$) of the sleeve portions is abutted against a side wall (a side wall 67) on a nip portion inlet (IN) side of the concave portion, and wherein when the internal holding member has the angle shape, an outer side of one of bent faces is abutted against the side wall on the nip portion inlet side of the concave portion.

(3) The fixing apparatus as recited in (1) or (2) in the above (FIGS. 14 and 15B), wherein the deform preventing unit includes an external holding member (an external holding member 70) which has an L-shaped angle shape or which has a groove shape with a cross section which is U-shaped and sleeve portions whose lengths differ, the external holding member being installed from an inner peripheral side of the supporting member to outside the concave portion, wherein when the external holding member has the groove shape, an inner face of a longer one (a sleeve portion $\mathbf{71}_{S2}$) of the sleeve portions is abutted against a side wall (a side wall 67) on a nip portion outlet (OUT) side of the concave portion, and wherein when the external holding member has the angle shape, an inner side of one of bent faces is abutted against the side wall on the nip portion outlet side of the concave portion.

(4) The fixing apparatus as recited in (3) in the above (FIG. 16), wherein the deform preventing unit includes the groove-shaped internal holding member and the groove-shaped external holding member, and wherein a distance from a corner portion ($C_{IN}$) at which an outer peripheral face of the supporting member on the nip portion inlet side of the supporting member and a side wall of the concave portion cross to a tip of the sleeve portion is shorter for the internal holding member (d1) than for the external holding member (d2).

(5) The fixing apparatus as recited in (3) or (4) in the above (FIG. 16), wherein the deform preventing unit includes the groove-shaped internal holding member and the groove-shaped external holding member, and wherein a distance from a corner portion ($C_{OUT}$) at which an outer peripheral face of the supporting member on the nip portion outlet side of the supporting member and a side wall of the concave portion cross to a tip of the sleeve portion is shorter for the external holding member (d4) than for the internal holding member (d3).

(6) The fixing apparatus as recited in (4) or (5) in the above (FIGS. 17 and 18), wherein the internal holding member and the external holding member include a reverse mounting preventing unit (a square hole 70*h*, a convex portion 71*a*) which prevents a direction of mounting the holding members in a direction of rotation of the fixing member from being a reverse direction.

(7) An image forming apparatus (an image forming apparatus 1, FIG. 1), includes the fixing apparatus (the fixing apparatus 20) as recited in any one of (1) to (6).

According to the fixing apparatus of the present invention, a deform preventing unit reinforces a concave portion of a supporting member to prevent the supporting member from deforming due to sliding of a fixing member, so that an anticipated shape of the supporting member is maintained, a sliding state between the supporting member and the fixing member is properly maintained, making it possible to improve energy conservation and durability of parts, and properly pass the recording medium through a nip section.

The image forming apparatus according to the present invention includes the fixing apparatus of the present invention, making it possible to stably form a good image over a long term.

DESCRIPTION OF THE REFERENCE NUMERALS

Figure 1:
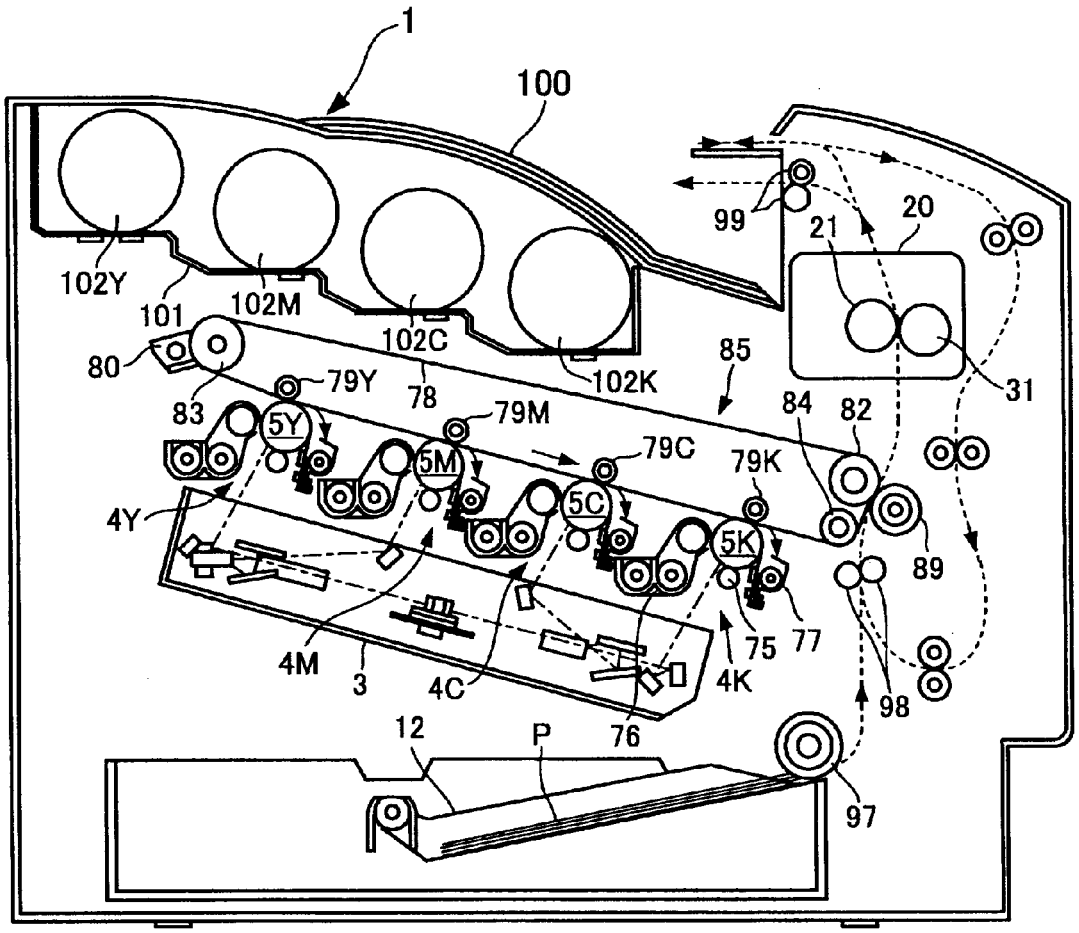
FIG. 1 is a schematic configuration diagram which shows an image forming apparatus provided with a fixing apparatus according to an embodiment of the present invention.

1 Image forming apparatus
3 Exposing unit
4Y, 4M, 4C, 4K Image forming units
5Y, 5M, 5C, 5K Photoconductor drums
12 Paper-supply unit
18 Maximum external diameter between heating region and separating region
19 Fixedly attaching member
20 Fixing apparatus
21 Fixing belt
21*a* Base material
21*b* Mold release layer
21*c* Coating film
22 Reflector plate
23 Reinforcing member
23*a* Body
23*b* Receiving projection
25 Heating unit
26 Nip forming member
26*a* Body
26*b* Supporting projection
26*c* Center line
27 Nip portion
28 Flange member
28*a* Cylindrical section
28*b* Flange section
28*c* Brim
29 Film member
31 Pressurizing roller (pressurizing member)
32 Center axle
33 Elastic layer
34 Mold release layer
42 Side plate
60 Supporting member
60*a* Coating film
61 Nip concave portion
62 Introducing region
63 Heating region
63*a* Arc center of heating region
64 Separating region
64*a* Arc center of separating region
65 Recess region
66 Intermediate region
67 Side wall
68 Base wall
69 Opening

70 External holding member
70*a* Mounting section
70*h* Square hole
70S0, 71S0 Base portions
70S1, 70S2, 71S1, 71S2 Sleeve portions
71 Internal holding member
71*a* Convex section
75 Charging unit
76 Developing unit
77 Cleaning unit
78 Intermediate transfer belt
79Y, 79M, 79C, 79K Primary transfer bias roller
80 Intermediate transfer cleaning unit
82 Secondary transfer backup roller
83 Cleaning backup roller
84 Tension roller
85 Intermediate transfer unit
89 Secondary transfer roller
97 Paper-supplying roller
98 Registration roller pair
99 Paper-discharge roller pair
100 Stacking unit
101 Bottle container
102Y, 102M, 102C, 102K Toner bottle
201 Heater
202, 203 Roller members
204 Fixing belt
205, 212 Pressurizing roller
211 Ceramic heater
213 Film
CIN, COUT Corner portion
IN Nip inlet side of nip convex portion
N Fixing nip portion
OUT Nip outlet side of nip concave portion
P Recording medium
T Toner image

Mode for Carrying Out the Invention

A description is given below with regard to embodiments of the present invention with reference to the drawings.

First, an image forming apparatus 1 according to an embodiment of the present invention is described with reference to FIG. 1.

As shown in FIG. 1, the image forming apparatus 1 is a tandem-type color printer. Four toner bottles 102Y, 102M, 102C, and 102K which correspond to colors (yellow, magenta, cyan, and black) are removably provided at a bottle container 101 which is located at an upper part of the image forming apparatus body 1. Thus, these four toner bottles 102Y, 102M, 102C, and 102K are replaceable by a user, etc.

An intermediate transfer unit 85 is arranged at a lower part of a bottle container 101. Image forming units 4Y, 4M, 4C, and 4K which correspond to the colors yellow, magenta, cyan, and black are installed together such that they oppose an intermediate transfer belt 78 of the intermediate transfer unit 85.

At the image forming units 4Y, 4M, 4C, and 4K are respectively provided photoconductor drums 5Y, 5M, 5C, and 5K. Moreover, surrounding each of the photoconductor drums 5Y, 5M, 5C, and 5K are a charging unit 75, a developing unit 76, a cleaning unit 77, a neutralizing unit (not shown), etc. Then, image forming processes (charging step, exposing step, developing step, transferring step, and cleaning step) are performed on the photoconductor drums 5Y, 5M, 5C, and 5K, so that images of the respective colors are formed on the photoconductor drums 5Y, 5M, 5C, and 5K.

The photoconductor drums 5Y, 5M, 5C, and 5K are rotationally driven in a clockwise direction in FIG. 1 with a driving motor (not shown). Then, surfaces of the photoconductor drums 5Y, 5M, 5C, and 5K are uniformly charged at locations of the corresponding charging units 75. (This is a charging step.) Then, the surfaces of the photoconductor drums 5Y, 5M, 5C, and 5K reach locations of irradiation of corresponding laser lights L emitted from an exposing unit 3, at which locations scan exposing is conducted to form electrostatic latent images. (This is an exposing step.)

Then, the surfaces of the photoconductor drums 5Y, 5M, 5C, and 5K reach locations opposing the corresponding developing units 76, at which locations the electrostatic latent images are developed, so that a toner image for each color is formed. (This is a developing step.) Then, the surfaces of the photoconductor drums 5Y, 5M, 5C, and 5K reach locations opposing the intermediate transfer belt 78 and respective primary transfer bias rollers 79Y, 79M, 79C, and 79K, at which locations the toner images on the photoconductor drums 5Y, 5M, 5C, and 5K are transferred onto the intermediate transfer belt 78. (This is a primary transferring step.) Here, a small amount of untransferred toner remains on the photoconductor drums 5Y, 5M, 5C, and 5K.

Then, the surfaces of the photoconductor drums 5Y, 5M, 5C, and 5K reach locations opposing the corresponding cleaning units 77, at which location untransferred toner which remains on the photoconductor drums 5Y, 5M, 5C, and 5K is mechanically collected by cleaning blades of the cleaning units 77.

Finally, the surfaces of the photoconductor drums 5Y, 5M, 5C, and 5K reach locations opposing corresponding neutralizing units (not shown), at which locations remaining electric potentials on the photoconductor drums 5Y, 5M, 5C, and 5K are removed. Thus, a series of image forming processes which is conducted on the photoconductor drums 5Y, 5M, 5C, and 5K is completed.

Then, the toner image of each color that is formed on the respective photoconductor drum 5 via the developing step is transferred onto the intermediate transfer belt 78 in a superposed manner. In this way, a four-color color image is formed on the intermediate transfer belt 78. Here, the intermediate transfer unit 85 includes the intermediate transfer belt 78, the four primary bias rollers 79Y, 79M, 79C, 79K, a secondary transfer backup roller 82, a cleaning backup roller 83, a tension roller 84, an intermediate transfer cleaning unit 80, etc. The intermediate transfer belt 78 is stretched and supported by the three rollers 82-84, and is also endlessly moved in an arrow direction in FIG. 1 by rotational driving of the roller 82.

The four primary transfer bias rollers 79Y, 79M, 79C, and 79K respectively put the intermediate transfer belt 78 between the four primary transfer bias rollers 79Y, 79M, 79C, and 79K and the photoconductor drums 5Y, 5M, 5C, and 5K to form primary transfer nips. Then, a transfer bias of a polarity which is reverse to a polarity of the toner is applied to the primary transfer bias rollers 79Y, 79M, 79C, and 79K. Then, the intermediate transfer belt 78 travels in the arrow direction to successively pass the primary transfer nips for the respective primary transfer bias rollers 79Y, 79M, 79C, and 79K. Thus, the toner images of the colors that are on the corresponding photoconductor drums 5Y, 5M, 5C, and 5K are primary transferred onto the intermediate transfer belt 78 in the superposed manner.

Then, the intermediate transfer belt 78 having the four-color toner image transferred thereon reaches a location which opposes a secondary transfer roller 89, at which location the secondary transfer backup roller 82 sandwiches the intermediate transfer belt 78 between the secondary transfer backup roller 82 and the secondary transfer roller 89 to form a secondary transfer nip. Then, toner image of four colors that is formed on the intermediate transfer belt 78 is transferred onto a recording medium P which is carried to the location of the secondary transfer nip. Then, untransferred toner which has not been transferred onto the recording medium P remains on the intermediate transfer belt 78. Then the intermediate transfer belt 78 reaches the location of the intermediate transfer cleaning unit 80. Then, at this location, untransferred toner on the intermediate transfer belt 78 is collected. In this way, a series of transfer processes performed on the intermediate transfer belt 78 is completed.

Here, the recording medium P which is carried to the location of the secondary transfer nip is what is carried from a paper supply unit 12 which is arranged at a lower part of the apparatus main body 1 via a paper-supplying roller 97, a registration roller pair 98, etc. More specifically, the recording medium P such as a transfer paper is stored in the paper supply unit 12 with multiple overlaid sheets of the recording medium P being stored. Then, when the paper-supplying roller 97 is rotationally driven in a counterclockwise direction in FIG. 1, the topmost recording medium P is supplied between rollers of the registration roller pair 98.

The recording medium P which is carried to the registration roller pair 98 stops at a location of a roller nip of the registration roller pair 98 which has stopped rotational driving. Then, in alignment with the timing of the color image on the intermediate transfer belt 78, the registration roller pair 98 is rotationally driven, so that the recording medium P is carried towards the secondary transfer nip. In this way, a desired color image is transferred onto the recording medium P.

Then, the recording medium P, onto which the color image has been transferred at the location of the secondary transfer nip, is carried to a location of a fixing apparatus 20. Then, the color image transferred onto the surface is fixed onto the recording medium P with heat and pressure due to a fixing belt 21 and a pressurizing roller 31 at this location. Then, the recording medium P is discharged out of the apparatus 1 via a location which is in between rollers of a paper-discharge roller pair 99. The transferred medium P which is discharged out of the apparatus by the paper-discharge roller pair 99 is stacked on a stacking unit 100 as an output image. In this way, a series of image forming processes in the image forming apparatus 1 is completed.

Next, a configuration of the fixing apparatus 20 according to the present embodiment is described.

Figure 2:
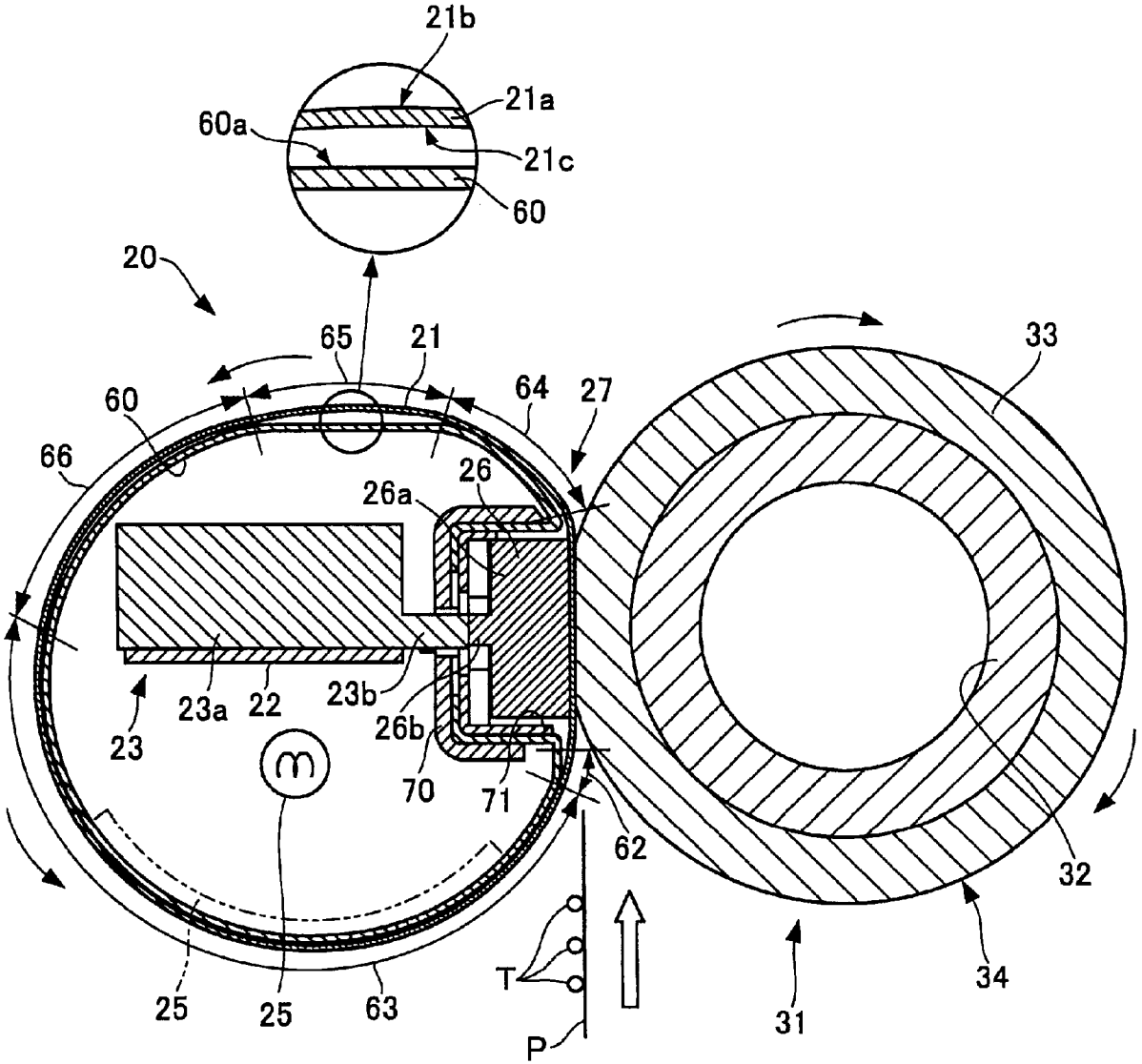
FIG. 2 is a central longitudinal sectional view of a fixing apparatus according to an embodiment of the present invention.
Figure 12:
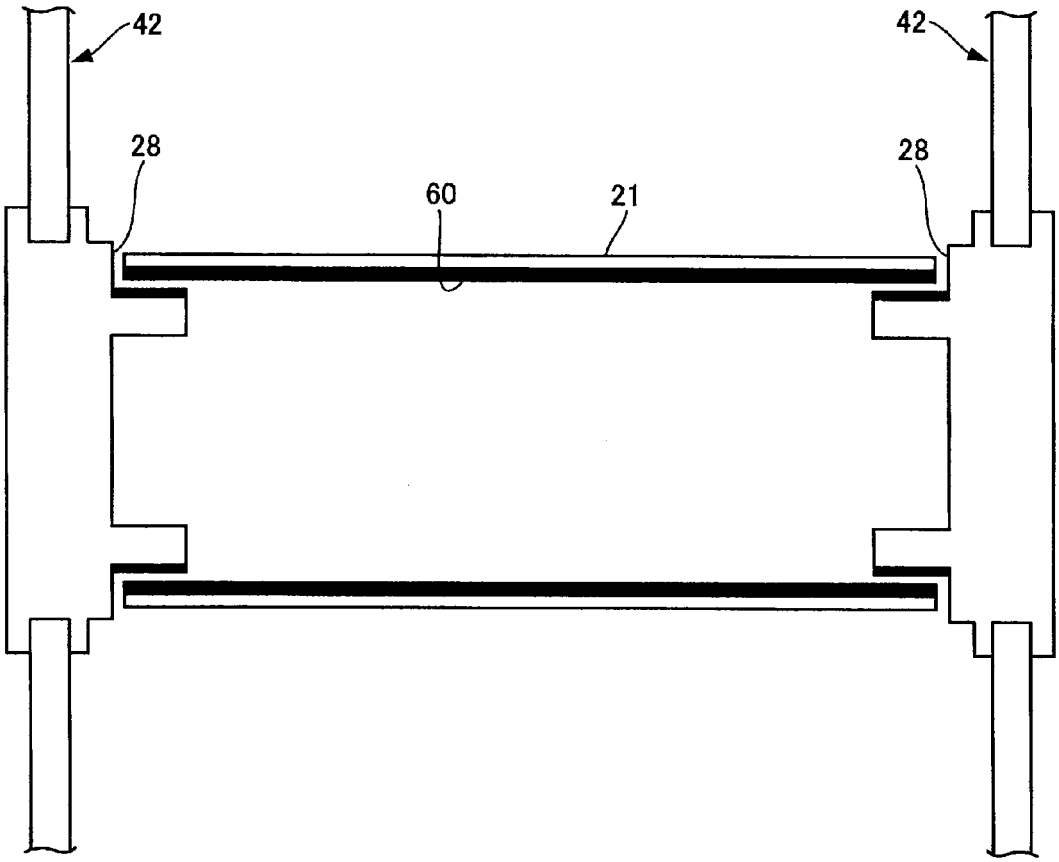
FIG. 12 is a perspective view of the supporting member, the flange member, and side plates of the fixing apparatus according to an embodiment of the present invention.

As shown in FIG. 2, the fixing apparatus 20 includes the endless-shaped fixing belt 21 which is rotatable and flexible; the pressurizing member 31 which is provided outside the fixing belt 21 in a radial direction and presses the fixing belt 21 toward inside the fixing belt 21 in the radial direction; a nip forming member 26 which is provided inside the fixing belt 21 in the radial direction and which puts in the fixing belt 21 between the nip forming member 26 and the pressurizing member 31 to press the fixing belt 21 together with the pressurizing member 31; a nip portion 27 which puts, between the fixing belt 21 and the pressurizing member 31, the recording medium P which bears a toner image T; a tubular (generally circular cylindrical, pipe-shaped) supporting member 60 (also called a heating member) which is provided on the inner peripheral side of the fixing belt 21 and which also rotatably supports the fixing belt 21, a heating unit 25 which heats the supporting member 60 to transfer heat to the fixing belt 21, a reinforcing member 23 which attaches the supporting member 60 to the image forming apparatus 1, flange members 28 which are provided at each end in the longitudinal direction of the fixing apparatus 20, and side plates 42, which are frames shown in FIG. 12, each of which supports the flange member 28 provided at the corresponding end.

The fixing belt 21, which has a cylindrical shape with an inner diameter of 30 mm, includes a base material 21*a* made of steel and which has a thickness of 30-50 μm, a mold release layer 21*b* which is formed on the front face side of the base material 21*a*, and a coating film 21*c* which is formed on the back face side of the base material 21*a*. The material which forms the base material 21*a* is not limited to steel, so that a metal material with high heat conductivity, such as cobalt, nickel, stainless steel, an alloy thereof, etc., or a synthetic resin material such as polyimide, etc., may be used.

The mold release layer 21*b* is provided for increasing mold releasability against the toner image T on the recording medium P. The mold release layer 21*b* is arranged to be made of PFA (tetrafluoroethylene/fluoroalkyl vinyl ether copolymer resin) with a thickness of 10-50 μm. The material which forms the mold release layer 21*b* is not limited to PFA, so that PTFE (tetrafluoroethylene resin), polyimide, polyether imide, PES (polyether sulfide), etc., may be used. The mold release layer 21*b* is provided to secure mold releasability against the toner image T.

The coating film 21*c* is provided in order to make frictional resistance with the supporting member 60 small. The coating film 21*c* is arranged to be Teflon (registered trademark) coating. The material which forms the coating film is not limited to Teflon (registered trademark), so that surface coating such as glass coating, DLC (Diamond-like carbon), plating, etc., may be used.

Figure 3:
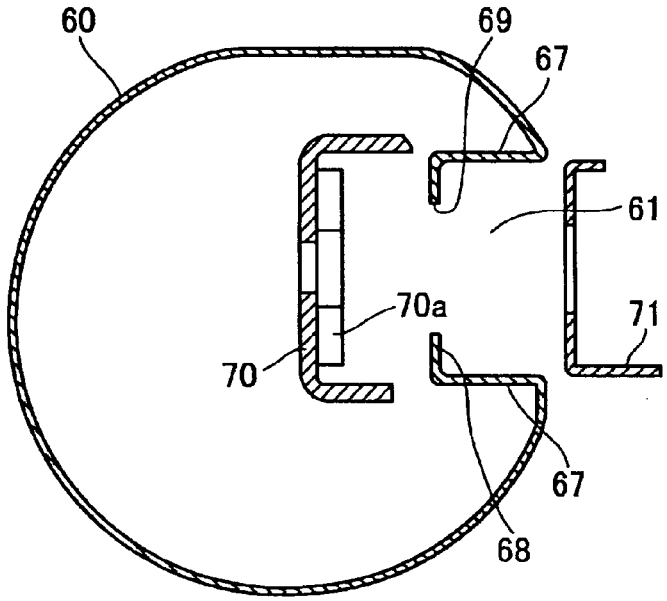
FIG. 3 is a central longitudinal sectional view showing a breakdown of a supporting member, an external holding member, and an internal holding member of the fixing apparatus according to the present invention.
Figure 4:
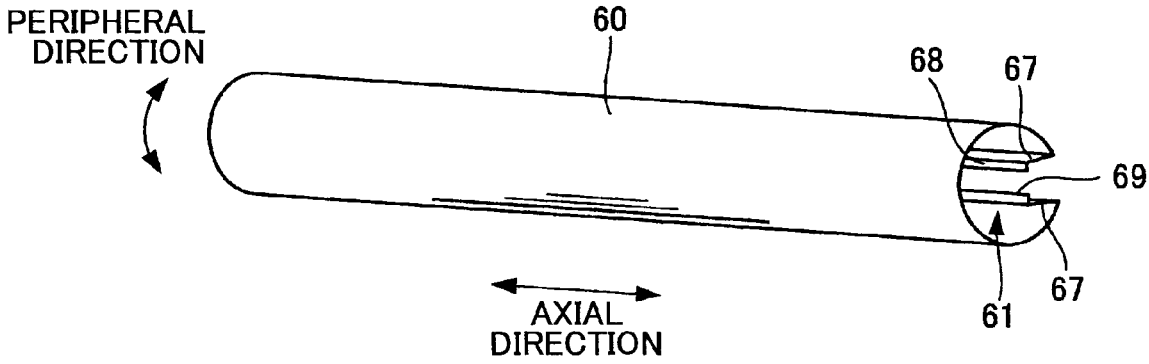
FIG. 4 is a perspective view of the supporting member of the fixing apparatus according to an embodiment of the present invention.
Figure 5:
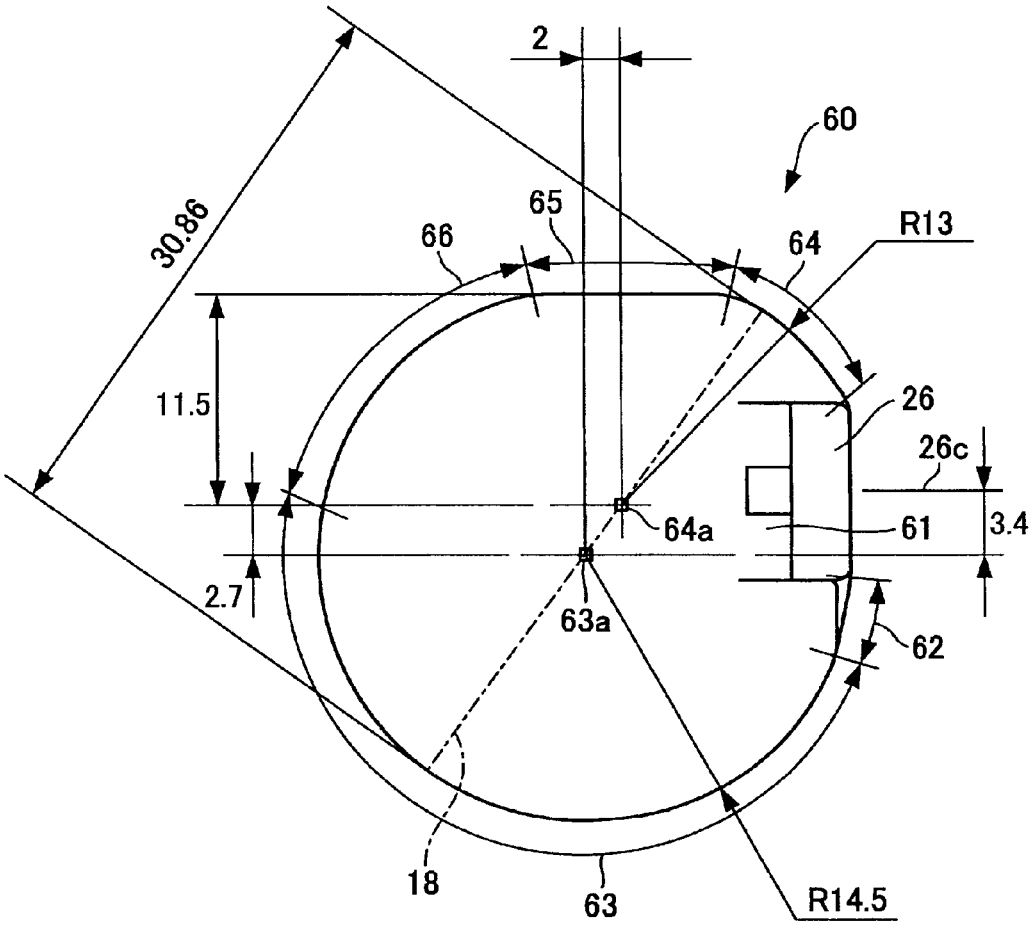
FIG. 5 is a schematic front view which shows dimensions of the supporting member of the fixing apparatus according to an embodiment of the present invention.

As shown in FIGS. 3-5, the supporting member 60 is arranged to be a pipe which is made of metal such as steel, which has a thickness of 0.1-1 mm, and which has a generally C-shaped cross section. The supporting member 60 includes a nip concave portion which houses the nip forming member 26 to form a part of the nip portion 27, an introducing region 62 which is provided on the upstream side in the rotating direction of the fixing belt 21 of the nip concave portion 61, a heating region 63 which is provided in continuation with the introducing region 62, a separating region 64 which is formed on the downstream side in the rotating direction of the fixing belt 21 of the nip concave portion 61, a recess region 65 which is flat and which is provided in continuation with the separating region 64, and an intermediate region 66 which is formed in continuation with the recess region 65 on the downstream side of the recess region 65 in the rotational direction and which is formed in continuation with the heating region 63. The supporting member 60 is formed by press molding.

The heating region 63, which has a cross section of an arc shape with a radius of 14.5 mm and which is in continuation with the nip concave portion 61 on the upstream side in the rotating direction of the nip concave portion 61, is arranged to be a region which is heated by the heating unit 25. Moreover, arc center 63*a* of the heating region 63 is arranged such that it is separated 3.4 mm to the upstream side in the recording medium carrying direction relative to a center line 26*c* in the recording medium carrying direction (shown with a whited out arrow in FIG. 2) of the nip forming member 26. In this way, the fixing belt 21 is pulled towards the downstream side in the recording medium carrying direction, so that it becomes more difficult for the fixing belt 21 to separate from the heating region 63. Moreover, the inner face of the supporting member 60, the heating region 63 in particular, is coated black. In this way, the transfer of radiant heat from the heating unit 25 is improved.

The introducing region 62 has a cross section shape formed such that a distance from the arc center 63*a* of the heating region 63 is smaller than a radius 14.5 mm of the heating region 63. In other words, the introducing region 62, which has a flat shape with a small curvature, is arranged such that it is in continuation with the nip concave portion 61 and the heating region 63. In this way, floating, from the supporting member 60, of the fixing belt 21 in the vicinity of the nip portion 27 is suppressed.

The separating region 64, having an arc-shaped cross section with a radius of 13 mm, which is smaller than a radius of 14.5 mm of the heating region 63, is arranged to be a region at which the recording medium P is separated from the fixing belt 21 by rapidly separating the fixing belt 21 from the recording medium P which has passed through the nip portion 27. Moreover, the arc center 64*a* of the separating region 64 is arranged such that it is 2.7 mm away to the downstream side in a recording medium carrying direction and 2 mm away to the nip portion 27 side relative to the arc center 63*a* of the heating region 63. In this way, the maximum external diameter 18, which connects the arc centers 63*a* and 64*a* of the heating region 63 and the separating region 64, becomes the maximum external diameter of the supporting member 60 and is 30.86 mm, thus becoming larger than the inner diameter of 30 mm of the fixing belt 21. In this way, the fixing belt 21 is pulled between the heating region 63 and the separating region 64, so that it becomes more difficult for the fixing belt 21 to separate from the heating region 63. Moreover, the peripheral length difference L2-L1 is arranged to be 0.7 mm when the external peripheral length of the supporting member 60 in which the nip forming member 26 is installed is set to L1 and the internal peripheral length of the fixing belt 21 is set to L2.

The intermediate region 66 has an arc shaped cross section with the same radius and the same center 63*a* as the heating region 63. In this way, the heating region 63 and the intermediate region 66 may be formed with the same curvature, so that the supporting member 60 is easily worked.

The recess region 65 is formed between the intermediate region 66 and the separating region 64 on a plane which is 11.5 mm away from the arc center 64*a* of the separating region 64 on the downstream side in the recording medium carrying direction. In this way, the supporting member 60 and the fixing belt 21 become contact-less in the recess region 65, so that frictional resistance is reduced.

As shown in FIG. 2, an external face of the supporting member 60 is coated with a coating film 60*a*. The coating film 60*a* is provided in order to make frictional resistance with the fixing belt 21 small. The coating film 60*a* is arranged to be Teflon (registered trademark) coating. The material which forms the coating film 60*a* is not limited to Teflon (registered trademark), so that surface coating such as glass coating, DLC, plating, etc., may be used. Moreover, grease is applied between the supporting member and the fixing belt 21. In this way, frictional resistance between the supporting member 60 and the fixing belt 21 becomes small.

As shown in FIG. 3, the nip concave portion 61 includes a pair of side walls 67 that extends in parallel towards inside the supporting member 60, a bottom wall 68 which links tips of each of the side walls 67, and an opening 69 which is formed at the bottom wall 68. An external holding member 70 which is provided outside the nip concave portion 61, or inside the supporting member 60 and which is generally U-shaped, for example, and an internal holding member 71 which is provided inside the nip concave portion 61, or outside the supporting member 60 and which is generally U-shaped, for example, are installed to the nip concave portion 61. The external holding member 70 and the internal holding member 71 nip the bottom wall 68 and the side wall 67 of the nip concave portion 61 of the supporting member 60 to screw them. The installing of the external holding member 70 and the internal holding member 71 maintains the shape of the nip concave portion 61. Moreover, a mounting portion 70*a* is formed at each end of the external holding member 70 in the longitudinal direction. The mounting portion 70*a* is fixed to the holding member 60 by the flange member 28.

Figure 6:
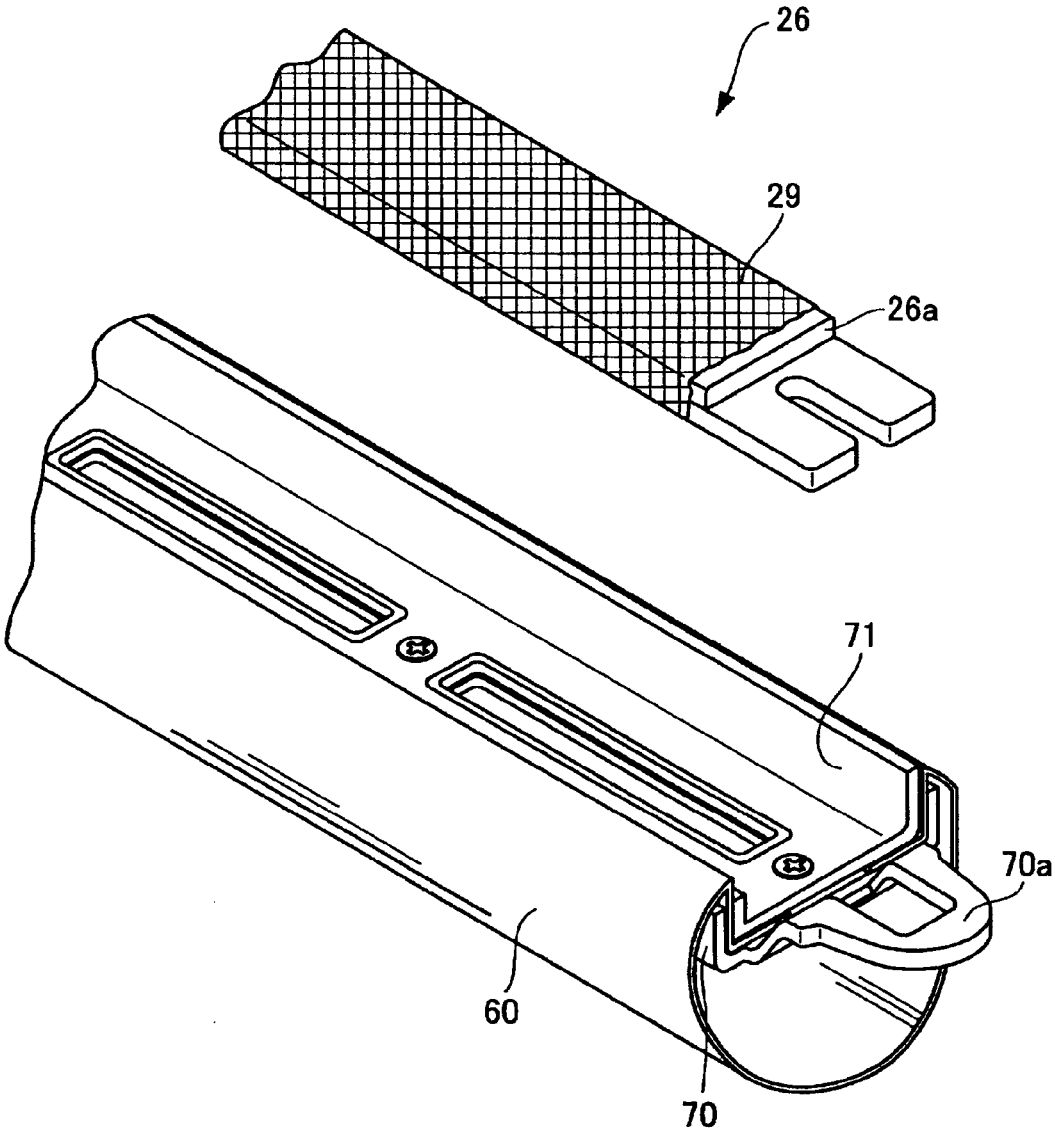
FIG. 6 is a perspective view showing the fixing apparatus according to the present invention with nip forming members removed.
Figure 7:
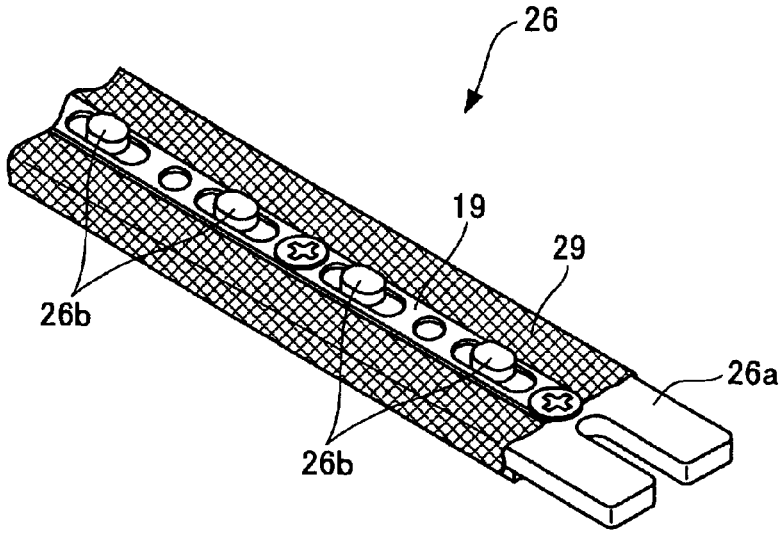
FIG. 7 is a perspective view showing the back side of the nip forming members of the fixing apparatus according to an embodiment of the present invention.

As shown in FIGS. 2, 6, and 7, the nip forming member 26 is provided inside the internal holding member 71. The nip forming member 26 is arranged to be made of a heat-resistant resin material such as PAI (polyamideimide), polyimide resin, or LCP (liquid crystal polymer) and have a generally square bar shape in the longitudinal direction of the supporting member 60. The nip forming member 26 includes a body 26*a* which opposes the pressurizing member 31, a supporting projection 26*b* which is abutted against and supported by the reinforcing member 23 at the back face of the body 26*a*, and a film member 29 which is provided surrounding the body 26*a*.

When the body 26*a* is pressed by the pressurizing member 31, the supporting projection 26*b* is abutted against and supported by the reinforcing member 23, so that being pushed by the pressurizing member 31 is prevented. A face on the pressurizing member 31 side of the nip forming member 26 is formed in a planer shape. It may also be arranged to be shaped in such a concave shape as to align with the surface of the pressurizing member 31.

The film member 29, which is made of a PTFE textile fabric, reduces frictional resistance with the fixing belt 21. The film member 29, which is wrapped around the body 26*a*, is fastened such that it is placed between the body 26*a* and a fixedly attaching member 19 screwed in the vicinity of the supporting projection 26*b*. The nip forming member 26 is fixed to the holding member 60 by the flange member 28.

Figure 8:
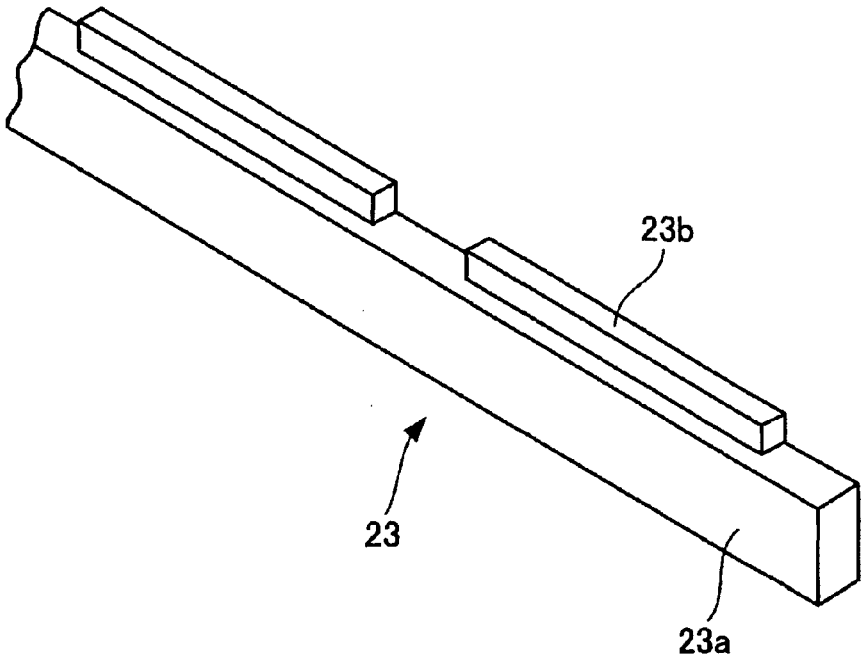
FIG. 8 is a perspective view of a reinforcing member of the fixing apparatus according to an embodiment of the present invention.

As shown in FIGS. 2 and 8, the reinforcing member 23 includes a highly rigid metal-made body 23*a*, which has a generally square bar shape along the longitudinal direction of the supporting member 60, a receiving projection 23*b* which abuts against the supporting projection 26*b* of the nip forming member 26, and a reflector plate 22 which opposes the heating unit 25. The receiving projection 23*b* abuts against the supporting projection 26*b* of the nip forming member 26 and supports from behind the nip forming member 26 which is pressed by the pressurizing member 31. The reflector plate 22 reflects radiant heat from the heating unit 25 to reduce quantity of heat which is transferred towards the body 23*a* of the reinforcing member 23. The reinforcing member 23 is fixed to the holding member 60 by the flange member 28.

The heating unit 25, which is a line-shaped heating body provided inside the supporting member 60 along the longitudinal direction thereof, is arranged to be a halogen heater in the present embodiment. The heating unit 25 is provided inside the heating region 63. In this way, the heating region 63 becomes a radiant region in which heat from the heating unit 25 is radiated without being blocked by the reinforcing member 23. Moreover, a temperature sensor which detects a temperature of the fixing belt 21 is provided at an appropriate location of the heating region 63.

Figure 9:
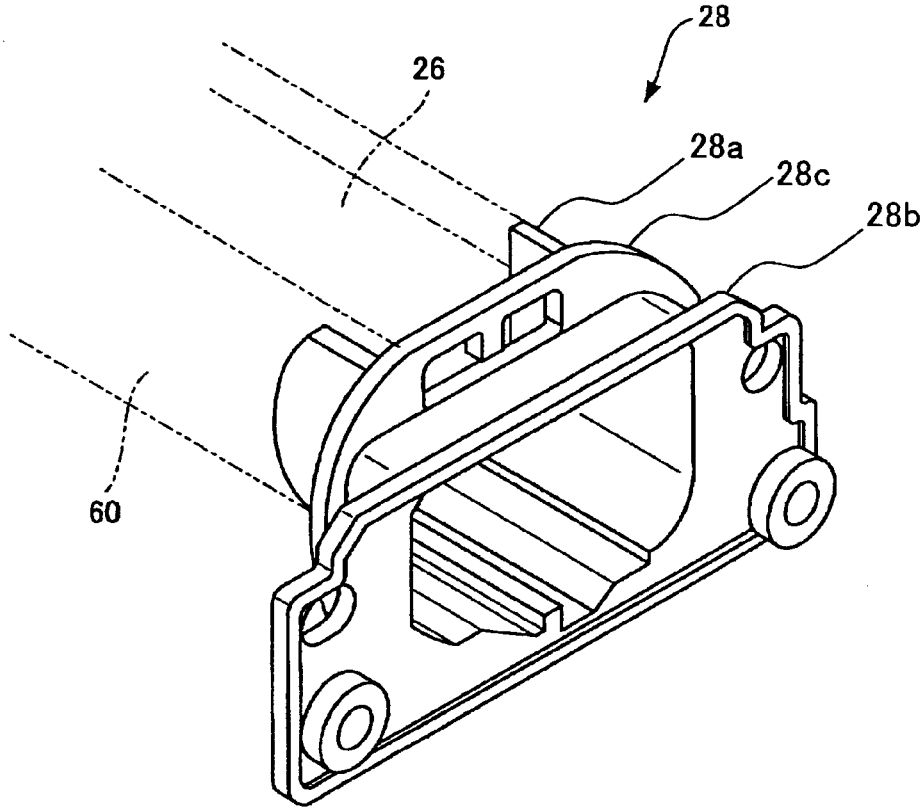
FIG. 9 is a perspective view of a flange member of the fixing apparatus according to an embodiment of the present invention.

As shown in FIG. 9, the flange member 28, which includes a cylindrical section 28*a*, one of which is inserted into an inner diameter section of each end of the supporting member 60 in an axial direction and which holds a shape in the vicinity of the corresponding end of the supporting member 60, and a flange section 28*b* which is securely installed on a corresponding side plate of the fixing apparatus 20, holds the nip forming member 26, the external holding member 70, the reinforcing member 23, and the heating unit 25 to fix them.

Moreover, the flange member 28 regulates movement of the fixing belt 21 in an axial direction with a brim 28*c*.

As described above, while the holding member 60 is arranged to have a predetermined cross sectional shape in order to obtain predetermined functions such as adhering to the fixing belt 21 to efficiently heat the fixing belt 21 in the heating region 63, maintain separability of the recording medium P in the separating region 64, etc., it is a thin metal pipe, so that there is a tendency for the working shape to vary and for it to be slided on by the fixing belt 21 to be deformed to undermine the anticipated functions. Thus, the holding of the external peripheral face of the cylindrical section 28*a* of the flange member 28 is arranged such that a shape in the vicinity of the end of the supporting member 60 becomes the shape as described above and anticipated functions are obtained in a stable manner. Thus, the clearance between the external peripheral face of the cylindrical section 28*a* and the inner peripheral face of the end of the supporting member 60 is arranged to be no more than 0.15 mm.

The pressurizing member 31, which is a pressurizing roller with an external diameter of 30 mm, includes a pipe-shaped center axle 32 which is made of metal, an elastic layer 33 which is made of heat-resistant silicone rubber and which is provided therearound, and a mold release layer 34 which is made of PFA and which is formed on the surface. The elastic layer 33 is arranged to have a thickness of 2-3 mm. The mold release layer 34 is formed such that it coats a PFA tube of a thickness of 50 μm. Moreover, a heating body such as a halogen heater may be built into the center axle 32 as needed.

Moreover, the pressurizing member 31 is pushed to the nip forming member 26 by a pressurizing mechanism (not shown) via the fixing belt 21. The pressurizing member 31 is pressed to the nip forming member 26 via the fixing belt 21 to form the nip portion 27. The pressurizing member 31 is rotated (an arrow direction in FIG. 2) by a driving mechanism (not shown) while it presses the fixing belt 21. The fixing belt 21 rotates with the above-described rotation and, at the same time, the recording medium P is carried while being pressed at the nip portion 27.

Next, the operation is described.

A user operates an operating panel, a computer, etc., to issue a request for printing. When an image forming apparatus receives an output signal due to the above-described request for printing, the pressurizing member 31 is rotated by the driving mechanism and the fixing belt 21 rotates with the pressurizing member 31 as well.

Here, with the arc center 63*a* of the heating region 63 being located on the upstream side in the recording medium carrying direction relative to a center line in the recording medium carrying direction of the nip forming member 26, the fixing belt 21 is pulled to the downstream side in the recording medium carrying direction, or the opposite side of the heating region 63, so that adhesion between the fixing belt 21 and the supporting member 60 in the heating region 63 increases, and, at the same time, it becomes more difficult for the fixing belt 21 to separate from the supporting member 60. Moreover, the heating region 63 has a cross sectional shape which is an arc shape with a radius of 14.5 mm which is generally the same as a radius of 15 mm of the fixing belt 21, so that, in the heating region 63, the fixing belt 21 adheres to the supporting member 60 with almost no transformability acting on the fixing belt 21, so that adhesion between the supporting member 60 and the fixing belt 21 increases. Moreover, with the maximum external diameter 18 of 30.86 mm which is between the heating region 63 and the separating region 64 being larger than the inner diameter of 30 mm of the fixing belt 21, the fixing belt 21 is pulled between the heating region 63 and the separating region 64, so that adhesion between the fixing belt 21 and the supporting member 60 in the heating region 63 increases, and, at the same time, it becomes more difficult for the fixing belt 21 to separate from the supporting member 60. Due to these reasons, the fixing belt 21 adheres to the supporting member 60 to slide on the supporting member 60 in the heating region 63.

On the other hand, in synchronization with a rotation of the pressurizing member 31, an electric current is sent to the heating unit 25, which generates heat. The heat of the heating unit 25 is radiated to the heating region 63, so that the heating region 63 is rapidly heated. Rotation of the pressurizing member 31 and heating by the heating unit 25 do not have to start at the same time, so that a time difference may be provided as needed. Then, a temperature of the fixing belt 21 is detected with a temperature sensor, the nip portion 27 is raised in temperature to a temperature necessary for fixing, after which feeding of the recording medium P is started while the temperature is maintained. With the recording medium P which passed through the nip portion 27, a toner image T of the recording medium P is fixed by pressure and heat of the nip portion 27.

As described above, according to an image forming apparatus of the present embodiment, adhesion between the fixing belt 21 and the supporting member 60 in the heating region 63 increases, and, at the same time, it becomes more difficult for the fixing belt 21 to separate from the supporting member 60, so that heat conductivity from the supporting member 60 to the fixing belt 21 increases, suppressing overheating of the supporting member 60 to make it possible to prevent degradation of the coating films 60*a* and 21*c*. Moreover, an increased adhesion between the supporting member 60 and the fixing belt 21 makes it possible to shorten warm-up time and first print time and to improve energy conservation.

Then, according to the present embodiment, the separation area 64 has a cross sectional shape of an arc with a radius which is smaller than a radius of the heating region 63, so that the fixing belt 21 is rapidly separated from the recording medium P. Thus, separability from the fixing belt 21 at the recording medium P after passing through the nip portion 27 may be improved.

Figure 11:
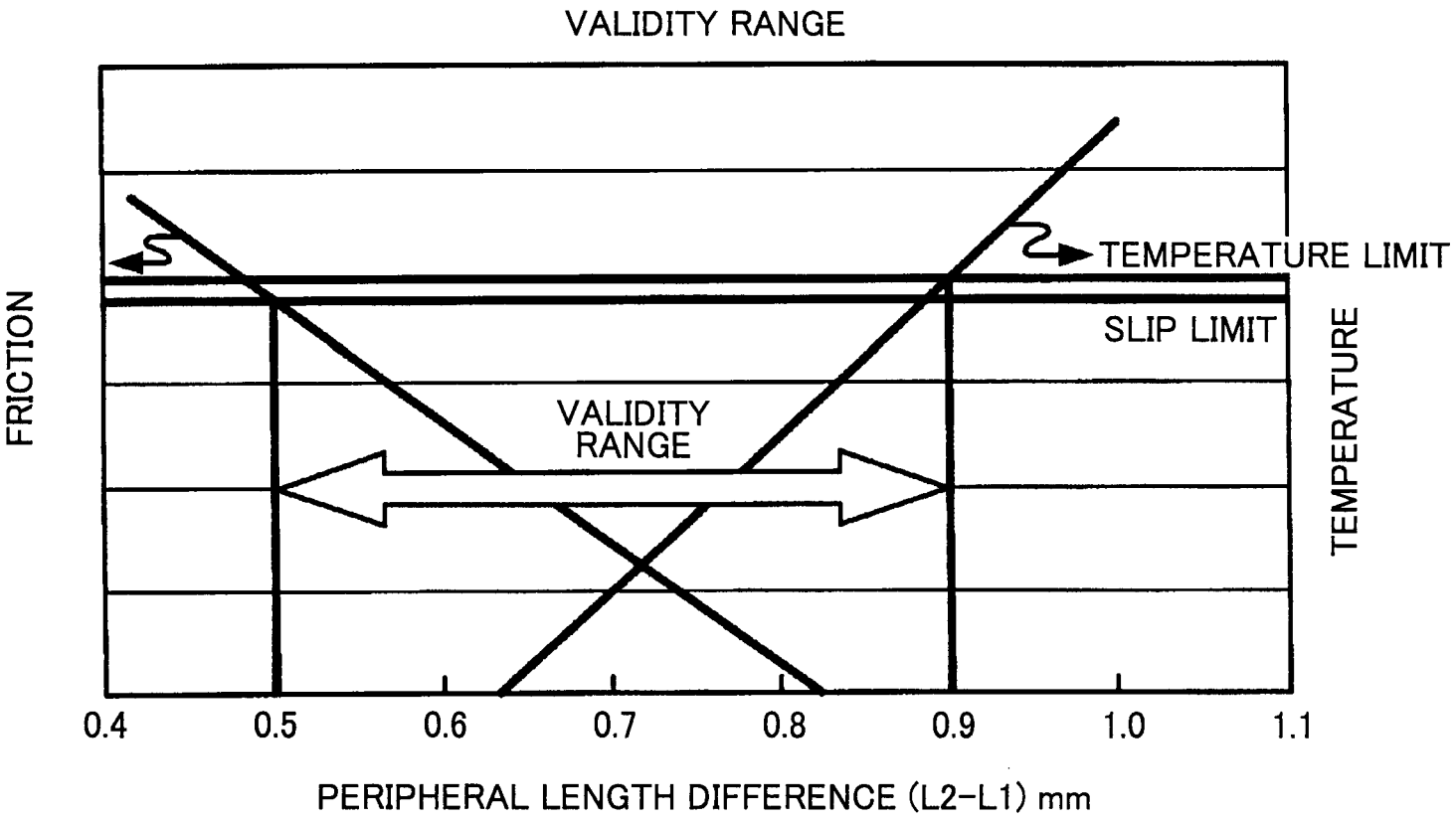
FIG. 11 is a graph indicating a relationship between peripheral length difference, and friction and temperature when a fixing belt with a diameter of 30 mm and the supporting member shown in FIG. 5 are used.

Moreover, according to the present embodiment, the peripheral length difference L2-L1 is arranged to be 0.5-0.9 mm when the external peripheral length of the supporting member 60 in which the nip forming member 26 is installed is set to L1 and the internal peripheral length of the fixing belt 21 is set to L2 (FIG. 11). Here, when the peripheral length difference exceeds 0.9 mm, the fixing belt 21 is loosely wrapped around the supporting member 60, so that the fixing belt 21 floats to cause an overheated portion in a part of the supporting member 60, making it easier for durability of the coating film to be deteriorate. Moreover, when the peripheral length difference is less than 0.5 mm, the fixing belt 21 is tightly wrapped around the supporting member 60, so that friction between the fixing belt 21 and the supporting member 60 increases to make it more difficult for the fixing belt 21 to rotate, making it more likely for the pressurizing member 31 and the recording medium P to slip against the fixing belt 21. Therefore, when the peripheral length difference L2-L1 is 0.5-0.9 mm as in the present embodiment, the fixing belt 21 never floats from the supporting member 60, making it possible to prevent overheating of the supporting member 60 and to prevent slipping of the recording medium P without the coiling of the fixing belt 21 around the supporting member 60 being too tight.

Moreover, according to the present embodiment, the fixing belt 21 is pulled between the heating region 63 and the separating region 64, so that the adherence of the fixing belt 21 and the supporting member 60 in the heating region 63 increases even when the fixing belt 21 is stopped. In this way, when the fixing apparatus 20 which has been stopped is activated to statically heat the fixing belt 21, the fixing belt 21 can be efficiently heated without overheating the supporting member 60.

Moreover, according to the present embodiment, with the heating unit 25 being a line-shaped heating body which is provided inside along the longitudinal direction of the supporting member 60, the line-shaped heating body has a simple installation structure, making it possible to simplify the configuration of the fixing apparatus 20. Moreover, the inner face of the supporting member 60 is coated black, so that the radiation rate at the supporting member 60 is improved, making it possible to shorten warm-up time and first-print time and to improve energy conservation.

Furthermore, the introducing region 62 is provided between the heating region 63 and the nip forming member 26 with a cross-sectional shape having a distance from the arc center 63*a* of the heating region 63 being smaller than the radius 14.5 mm of the heating region 63, making it possible to prevent in the introducing region 62 the fixing belt 21 from floating from the external peripheral face of the supporting member 60 and to prevent the supporting member 60 from overheating.

Then, according to the present embodiment, the intermediate region 66 has a cross-sectional shape which is an arc shape with the same radius and center 63*a* as the heating region 63, making it is possible to form the heating region 63 and the intermediate region 66 with the same curvature. Thus, the supporting member 60 may be easily worked and the manufacturing cost may be reduced.

Moreover, according to the present embodiment, with a flat recess region 65 being provided between the intermediate region 66 and the separating region 64, the supporting member 60 and the fixing belt 21 become contact-less in the recess region 65, so that frictional resistance therebetween decreases such that it becomes even smaller than the frictional resistance between the fixing belt 21 and the recording medium P, making it possible to suppress slipping of the recording medium P against the fixing belt 21. Moreover, material for forming the supporting material 60 may be shortened, making it possible to reduce material cost.

Furthermore, according to the present embodiment, the inner face of the fixing belt 21 and the outer face of the supporting member 60 are coated with coating films 21*c* and 60*a*, respectively, and grease is applied therebetween, so that frictional resistance of a sliding portion between the supporting member 60 and the fixing belt 21 decreases such that it becomes smaller than the frictional resistance between the fixing belt 21 and the recording medium P, making it possible to suppress slipping of the recording medium P against the fixing belt 21.

In the image forming apparatus according to the present embodiment, while the peripheral length difference L2-L1 is arranged to be 0.7 mm when the outer peripheral length of the supporting member 60 in which the nip forming member 26 of the fixing apparatus 20 in the present invention is set to L1 and the inner peripheral length of the fixing belt 21 is set to L2, it is not limited thereto.

In other words, when the difference between the inner peripheral length of the fixing belt 21 and the outer peripheral length of the supporting member 60 exceeds 0.9 mm, the fixing belt 21 is loosely wrapped around the supporting member 60, so that the fixing belt 21 may float to cause an overheated portion in a part of the supporting member 60, so that durability of the coating film may be reduced. Moreover, when the difference between the inner peripheral length of the fixing belt 21 and the outer peripheral length of the supporting member 60 is less than 0.5 mm, the fixing belt 21 is tightly wrapped around the supporting member 60, so that friction between the fixing belt 21 and the supporting member 30 may increase, making it more difficult for the fixing belt 21 to rotate and making it more likely for the pressurizing member 31 and the recording medium P to slip against the fixing belt 21.

Thus, it suffices for the peripheral length difference between the inner peripheral length of the fixing belt 21 and the outer peripheral length of the supporting member 60 to be 0.5-0.9 mm, more preferably 0.6-0.8 mm, and most preferably 0.7 mm, making it possible to prevent overheating of the supporting member 60 while suppressing slipping of the recording medium P within the above-described ranges. Depending on whether the coating films 21*c*, 60*a* and the grease are present, or on the shape and dimensions of each element, the peripheral length difference is not limited to 0.5-0.9 mm, so that it may be set appropriately.

Moreover, in the image forming apparatus of the present embodiment, while the intermediate region 66 of the supporting member 60 of the fixing apparatus 20 of the present invention is arranged to have an arc-shaped cross-section having the same radius and the same center 63*a* as the heating region 63, it is not limited thereto, so that it may be arranged to have a cross-sectional shape having a distance from the arc center 63*a* of the heating region 63 that is smaller than the radius of the heating region 63 as long as it does not interfere with the reinforcing member 23, for example. In this case, with the supporting member 60 and the fixing belt 21 becoming contact-less in the intermediate region 66, frictional resistance therebetween decreases such that it becomes even smaller than the frictional resistance between the fixing belt 21 and the recording medium P, making it possible to suppress slipping of the recording medium P against the fixing belt. Moreover, material for forming the supporting material 60 may be shortened, making it possible to reduce material cost.

Moreover, in the image forming apparatus according to the present embodiment, while the fixing belt 21 of the fixing apparatus 20 is arranged to have a diameter of 30 mm, it is not limited thereto, so that the diameter may be set to 15-120 mm, or more specifically 25 mm, for example.

Furthermore, in the image forming apparatus according to the present embodiment, the heating unit 25 of the fixing apparatus 20 is arranged to be a line-shaped heating body such as a halogen heater, it is not limited thereto, so that it may be arranged to be a plane-shaped heating body which is provided so as to contact the inner peripheral face along the longitudinal direction of the supporting member 60 as shown in FIG. 2 in an imaginary line.

Figure 10:
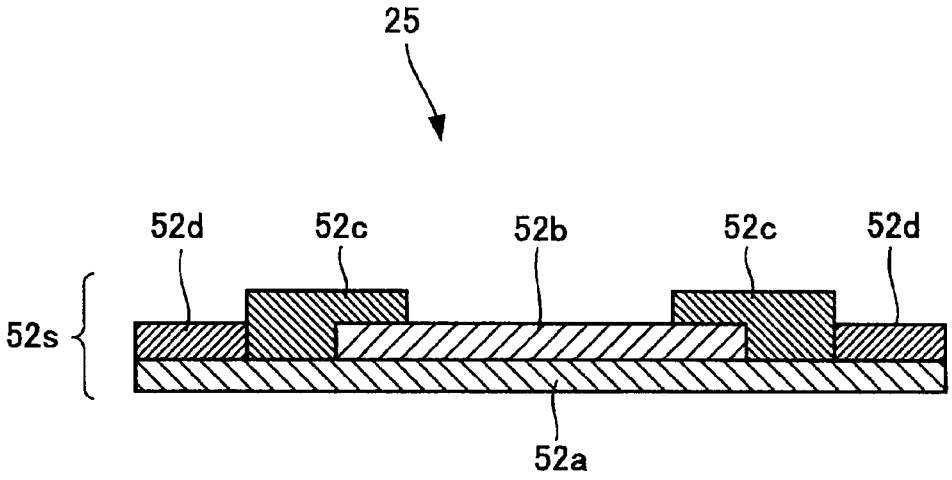
FIG. 10 is a cross-sectional diagram showing a heating unit which includes planar heating bodies.

As shown in FIG. 10 for example, the plane-shaped heating body includes a flexible heating sheet 52*s* having a predetermined width and length corresponding to the axial and peripheral directions of the fixing belt 21. The heating sheet 52*s* includes a base layer 52*a* which has insulating properties, a resistive heating layer 52*b* at which conductive particles are dispersed in a heat-resistive resin, and an electrode layer 52*c* which supplies electric power to the resistive heating layer 52*b*. On the base layer 52*a*, an insulating layer 52*d* is provided which insulates around the electrode layer 52*c*, which is a different feeding system neighboring the resistive heating layer 52*b*, and which insulates between an edge portion of the heating sheet 52*s* and the outside. Moreover, the plane-shaped heating body, which is connected to the electrode layer 52*c* at the end of the heating sheet 52*s*, includes an electrode terminal which supplies power provided from a feeding line to the electrode layer 52*c*. The plane-shaped heating body is not limited to the above-described configuration, so that a different configuration may be adopted.

The plane-shaped heating body is applied and the line-shaped heating body is omitted, so that the heating region 63 becomes a contacting region at which heat is conducted from the heating unit 25 which includes the plane-shaped heating body. In this way, the plane-shaped heating body may efficiently heat the supporting member 60, making it possible to shorten the warm up time and the first print time and to improve energy conservation.

Alternatively, the heating unit 25 may be provided outside or inside the supporting member 60, so that it is an inductive coil which inductively heats the supporting member 60. In this case, the heating region 63 is an opposing region which is inductively heated opposing the heating unit 25. In this way, with the inductive heating, elements other than the supporting member 60 are not directly heated, so that, unlike the line-shaped heating body, an element other than the supporting member 60, such as the reinforcing member 23, for example, is not heated, making it possible to efficiently heat the supporting member 60.

EXAMPLE

Using the supporting member 60 with the dimensions and shape shown in FIG. 5 under the same conditions as the above-described embodiment, various measurements were made, varying only the peripheral length difference L2-L1 between the inner peripheral length L2 of the fixing belt 21 and the outer peripheral length L1 of the supporting member 60 in which the nip forming member is installed. The measurements were made for the relationship between the surface temperature of the supporting member 60 and the peripheral distance difference and the relationship between the friction of the fixing belt 21 and the supporting member 60 and the peripheral length difference.

The results are shown in FIG. 11. As shown in FIG. 11, when the peripheral length difference exceeds 0.9 mm, the surface temperature of the supporting member 60 exceeded a predetermined temperature limit value. In other words, it is supposed that, when the peripheral length difference exceeds 0.9 mm, the fixing belt 21 is loosely wrapped around the supporting member 60, so that the fixing belt 21 floats to cause an overheated portion in a part of the supporting member 60 to exceed the temperature limit. Thus, it has been revealed that, when the peripheral length difference exceeds 0.9 mm, overheating of the supporting member 60 leads to durability of the coating film 60*a* becoming more likely to be reduced.

Moreover, when the peripheral length difference is less than 0.5 mm, friction between the supporting member 60 and the fixing belt 21 exceeded a predetermined limit value. In other words, it is supposed that, when the peripheral length difference is less than 0.5 mm, the fixing belt 21 is tightly wrapped around the supporting member 60, so that the frictional force between the fixing belt 21 and the supporting member 60 increases, so that slipping limit value of the recording medium P and the pressurizing member 31 has been exceeded. Thus, it has been revealed that, when the peripheral length difference is less than 0.5 mm, it has become more difficult for the fixing belt 21 to rotate and it has become more likely for the pressurizing member 31 and the recording medium P to slip against the fixing belt 21.

On the basis of these results, it has been revealed that the peripheral length difference between the inner peripheral length of the fixing belt 21 and the outer peripheral length of the supporting member 60 is 0.5-0.9 mm, more preferably 0.6-0.8 mm and most preferably 0.7 mm. In this way, it is verified that slipping of the recording medium P may be suppressed while preventing overheating of the supporting member 60.

Now, in the fixing apparatus 20, in order to efficiently conduct heat from the supporting member 60 to the fixing belt 21, it is important that the supporting member 60 and the fixing belt 21 are in proper contact, impacting energy conservation in its turn. In other words, when the pressure of the fixation belt 21 being in contact with the support member 60 is too high, rotational load of the fixing belt 21 increases, causing a problem of slipping of the fixing belt 21. Then, when slipping of the fixing belt 21 occurs, diffusion of heat by rotating ceases to occur, causing inflammation and decrease in durability of parts due to local heat supply. Moreover, transportability of the recording medium decreases and deviation occurs in heat supply to cause image quality anomalies such as deviation in gloss, fixing failure, etc. On the other hand, heat transfer efficiency decreases when the pressure of the fixing belt 21 being in contact with the supporting member 60 is too low, and, as it is, there is a lack of temperature of the fixing belt 21, so that heat supply from the heating unit 25 increases, causing reduction in energy conservation. Moreover, the supporting member 60 overheats, impacting the durability of the coating film 60*a* of the surface. Thus, as described previously, in order to achieve predetermined performance such as being able to adhere to the fixing belt 21 in the heating region 63 to efficiently heat the fixing belt 21, the supporting member 60 is arranged to have a predetermined cross-sectional shape.

Figure 13:
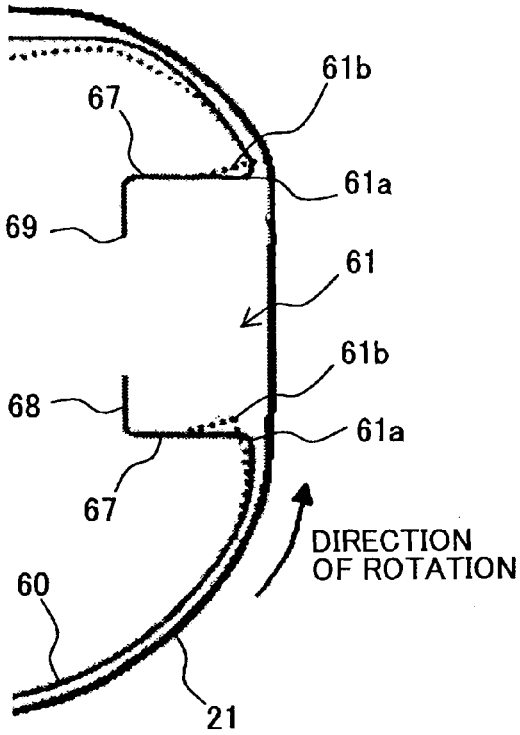
FIG. 13 is an explanatory diagram of deforming in the supporting member of the fixing apparatus of the present invention.

However, there is a tendency for the supporting member 60 to undermine anticipated functions by being deformed by sliding contact with the fixing belt 21 or by being deformed by being thermally affected by the heating unit 25 since it is a thin metal pipe. In particular, the supporting member 60 is provided with a nip concave portion 61, which is bent such that the opening 69 of a C shaped pipe member as shown in FIG. 13 is on the bottom face side in order to arrange the nip forming member 26 (not shown); when the fixing belt 21 rotates and slides at the time of driving the apparatus (or when the supporting member 60 thermally expands due to being heated by the heating unit 25), load concentrates at the nip concave portion 61 of the supporting member 60; and a corner portion, at which the side wall 67 of the nip concave portion 61 and the outer peripheral face of the supporting member 60 at each of inlet and outlet sides of the nip portion of the supporting member 60 cross, ends up getting deformed in the direction of rotation of the fixing belt 21 from a state of the proper position 61*a* which is shown in a solid line to a state of a deformed position 61*b* which is shown in a dotted line. Moreover, the deforming increases as the supporting member 60 is made thinner in order to increase heat transfer efficiency. In this way, when the supporting member 60 deforms, the peripheral length difference between the inner peripheral length of the fixing belt 21 and the outer peripheral length of the supporting member 60 changes, so that it becomes no longer possible to achieve anticipated performance in the supporting member 60, causing slipping of the fixing belt 21 and local overheating of the supporting member 60, leading to problems of reduction in energy conservation, decrease in durability of parts, image quality anomalies, etc.

Thus, in the present invention, in order to solve the problem described above, a deform preventing unit is provided which reinforces the nip concave portion 61 to prevent the supporting member 60 from deforming due to sliding of the fixing belt 21.

Figure 14:
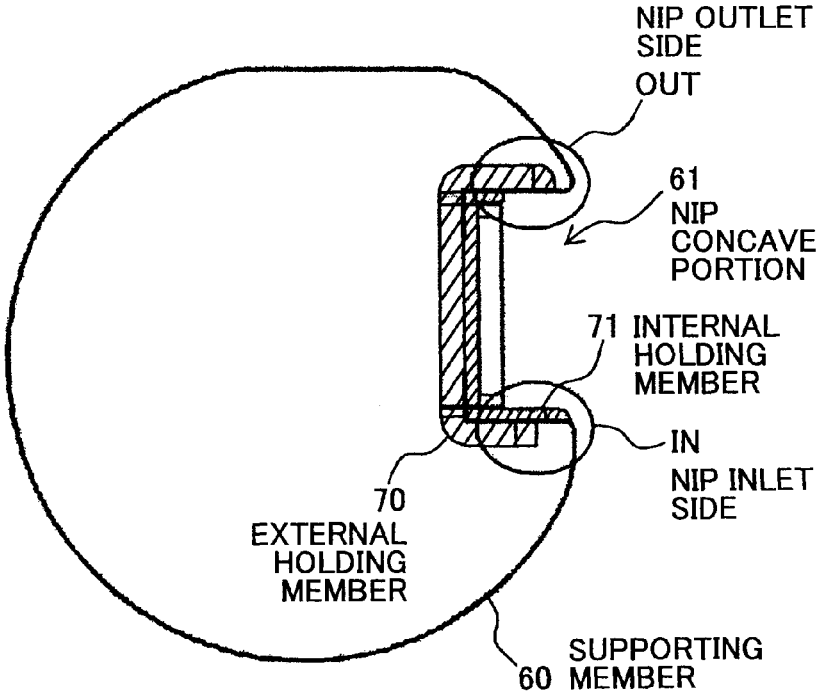
FIG. 14 is a cross-sectional diagram which shows a first part of how the internal holding member and the external holding member are installed in the supporting member at a nip concave portion.

More specifically, as shown in FIG. 14, the deform preventing unit preferably includes the groove-shaped internal holding member 71 with a cross section having a U shape and each of sleeve portions having different lengths, the groove-shaped internal holding member 71 being installed from the outer peripheral side of the supporting member 60 to inside the nip concave portion 61.

Figure 15B:
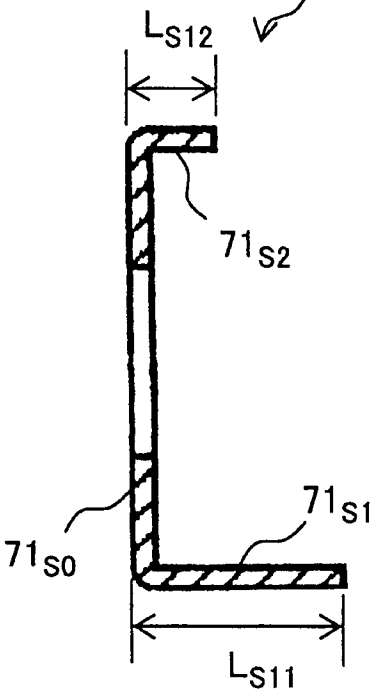
FIGS. 15A and 15B are cross-sectional diagrams which indicate the features of the external holding member and the internal holding member.

In other words, as shown in FIG. 15B, the internal holding member 71, which is a groove-shaped member having a U-shaped cross section, includes a sleeve portion $\mathbf{71}_{S1}$ and a sleeve portion $\mathbf{71}_{S2}$, which are bent 90 degrees in the same direction at corresponding ends in the lateral direction of a base portion $\mathbf{71}_{S0}$ that corresponds to the direction of rotation of the fixing belt 21.

Here, with a length $L_{S11}$ of the sleeve portion $\mathbf{71}_{S1}$ being arranged to be longer than a length $L_{S12}$ of the sleeve portion $\mathbf{71}_{S2}$ (FIG. 15B), the base portion $\mathbf{71}_{S0}$ is fixed to the bottom wall 68, so that the outer face of the sleeve portion $\mathbf{71}_{S1}$, which is a longer sleeve portion, is abutted against the inner face of the side wall of the nip portion inlet IN side of the nip concave portion 61 of the supporting member 60 (FIG. 14).

In order to suppress deforming of the corner portion at which the side wall 67 of the nip concave portion 61 and the outer peripheral face of the supporting member 60 cross, it is more advantageous to have a larger area of contact between the side wall 67 and the sleeve portion above-described corner portion to the tip of the sleeve portion $\mathbf{71}_{S1}$ is preferably no more than 1.5 mm, and is preferably no more than 1.0 mm.

On the other hand, the sleeve portion $\mathbf{71}_{S2}$ does not contribute to suppressing deforming, due to sliding of the fixing belt 21, of the corner portion at which the side wall 67 of the nip concave portion 61 and the outer peripheral face of the supporting member 60 on the nip portion outlet OUT side of the nip concave portion 61 cross. This is because the sleeve portion $\mathbf{71}_{S2}$ is arranged on the side which is opposite the direction of deforming of the corner portion. Therefore, for the sleeve portion $\mathbf{71}_{S2}$, the area of contact with the side wall 67 is not needed as much as for the sleeve portion $\mathbf{71}_{S1}$. Moreover, considering that the supporting member 60 is for being heated by the heating unit 25, so that the heat is conducted to the fixing belt 21, it is desirable that heat capacity is as small as possible for the internal holding member 71, which is installed in the supporting member 60. Moreover, for the aspect of mounting, it is desirable to make each member small in order to avoid interference among the parts. Thus, the sleeve portion $\mathbf{71}_{S2}$ preferably has a length which is shorter than that of the sleeve portion $\mathbf{71}_{S1}$, so that, for example, the distance from the corner portion at which the side wall 67 of the nip concave portion 61 and the outer peripheral face of the supporting member 60 cross to the tip of the sleeve portion $\mathbf{71}_{S2}$ is preferably no less than 2.0 mm, and is more preferably no less than 2.5 mm.

In this way, the internal holding member 71 is used to suppress increase in cost and heat capacity (consumed power), and, at the same time, as shown in FIG. 13, the sleeve portion $\mathbf{71}_{S1}$ of the internal holding member 71 supports the side wall 67 on the nip portion inlet IN side of the nip concave portion 61, making it possible to prevent deforming, due to sliding of the fixing belt 21, of the corner portion at which the side wall 67 of the nip concave portion 61 and the outer peripheral face of the supporting member 60 cross.

The internal holding member 71 may be arranged to have an L-shaped angle shape, including only the base portion $\mathbf{71}_{S0}$ and the sleeve portion $\mathbf{71}_{S1}$ and not including the sleeve portion $\mathbf{71}_{S2}$ in FIG. 15B. In this case as well, the base portion $\mathbf{71}_{S0}$ is fixed to the base wall 68, so that an outer face (one of bent faces) of the sleeve portion $\mathbf{71}_{S1}$ is abutted against the side wall on the nip portion inlet IN side of the nip concave portion 61 of the supporting member 60, making it possible to prevent deforming of the corner portion at which the side wall 67 of the nip concave portion 61 and the outer peripheral face of the supporting member 60 cross.

Moreover, as shown in FIG. 14, the deform preventing unit preferably includes the groove-shaped external holding member 70 with the cross section having a U shape and each of sleeve portions having different lengths, the groove-shaped external holding member 70 being installed from the inner peripheral side of the supporting member 60 to outside of the nip concave portion 61.

Figure 15A:
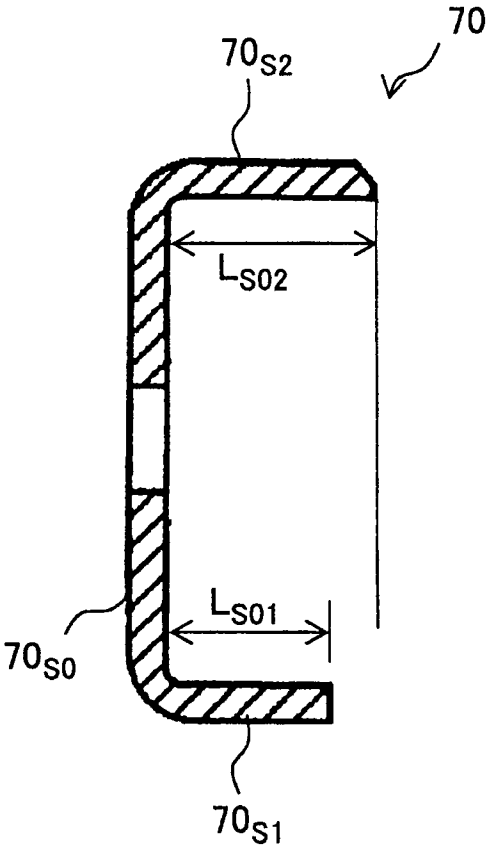

In other words, as shown in FIG. 15A, the external holding member 70, which is a groove-shaped member having a U-shaped cross section, includes a sleeve portion $\mathbf{70}_{S1}$ and a sleeve portion $\mathbf{70}_{S2}$, which are bent 90 degrees in the same direction at corresponding ends in the lateral direction of a base portion $\mathbf{70}_{S0}$ that corresponds to the direction of rotation of the fixing belt 21.

Here, with a length $L_{S02}$ of the sleeve portion $\mathbf{70}_{S2}$ being arranged to be longer than a length $L_{S01}$ of the sleeve portion $\mathbf{70}_{S1}$ (FIG. 15A), the base portion $\mathbf{70}_{S0}$ is fixed to the bottom wall 68, so that the inner face of the sleeve portion $\mathbf{70}_{S2}$, which is a longer sleeve portion, is abutted against the outer face of the side wall of the nip portion outlet OUT side of the nip concave portion 61 of the supporting member 60 (FIG. 14).

In order to suppress deforming of the corner portion at which the side wall 67 of the nip concave portion 61 and the outer peripheral face of the supporting member 60 cross, it is more advantageous to have a larger area of contact between the side wall 67 and the sleeve portion $\mathbf{70}_{S2}$, so that, for example, the distance from the above-described corner portion to the tip of the sleeve portion $\mathbf{70}_{S2}$ is preferably no more than 1.5 mm, and is more preferably no more than 1.0 mm.

On the other hand, the sleeve portion $\mathbf{70}_{S1}$ does not contribute to suppressing deforming, due to sliding of the fixing belt 21, of the corner portion at which the side wall 67 of the nip concave portion 61 and the outer peripheral face of the supporting member 60 on the nip portion inlet IN side of the nip concave portion 61 cross. This is because the sleeve portion $\mathbf{70}_{S1}$ is arranged on the side which is opposite the direction of deforming of the above-described corner portion. Therefore, for the sleeve portion $\mathbf{70}_{S1}$, the area of contact with the side wall 67 is not needed as much as for that of the sleeve portion $\mathbf{70}_{S2}$. Moreover, considering that the supporting member 60 is to be heated by the heating unit 25, so that the heat is conducted to the fixing belt 21, it is desirable that heat capacity is as small as possible also for the external holding member 70, which is installed in the supporting member 60. Moreover, for the aspect of mounting, it is desirable to make each member small in order to avoid interference among the parts. Thus, the sleeve portion $\mathbf{70}_{S1}$ preferably has a length which is shorter than that of the sleeve portion $\mathbf{70}_{S2}$, so that, for example, the distance from the corner portion at which the side wall 67 of the nip concave portion 61 and the outer peripheral face of the supporting member 60 cross to the tip of the sleeve portion $\mathbf{70}_{S1}$ is preferably no less than 2.0 mm, and is more preferably no less than 2.5 mm.

In this way, the external holding member 70 is used to suppress increase in cost and heat capacity (consumed power), and, at the same time, as shown in FIG. 13, the sleeve portion $\mathbf{70}_{S2}$ of the external holding member 70 supports the side wall 67 on the nip portion outlet OUT side of the nip concave portion 61, making it possible to prevent deforming, due to sliding of the fixing belt 21, of the corner portion at which the side wall 67 of the nip concave portion 61 and the outer peripheral face of the supporting member 60 cross.

The external holding member 70 may be arranged to have an L-shaped angle shape, including only the base portion $\mathbf{70}_{S0}$ and the sleeve portion $\mathbf{70}_{S2}$ and not including the sleeve portion $\mathbf{70}_{S1}$ in FIG. 15A. In this case as well, the base portion $\mathbf{70}_{S0}$ is fixed to the base wall 68, so that an inner face (one of the bent faces) of the sleeve portion $\mathbf{70}_{S2}$ is abutted against the outer face of the side wall on the nip portion outlet OUT side of the nip concave portion 61 of the supporting member 60, making it possible to prevent deforming of the corner portion at which the side wall 67 of the nip concave portion 61 and the outer peripheral face of the supporting member 60 cross.

Moreover, the term installing herein means being directly or indirectly fixed to the supporting member 60 such that reinforcing of the nip concave portion 61 is possible and may be any appropriate fixing method such as screwing, adhering, etc. For example, in FIG. 14 the external holding member 70 and the internal holding member 71 are screwed to each other, having placed the bottom wall 68 and the side wall 67 of the nip concave portion 61 therebetween, so that they are fixed to the supporting member 60, reinforcing the nip concave portion 61.

Figure 16:
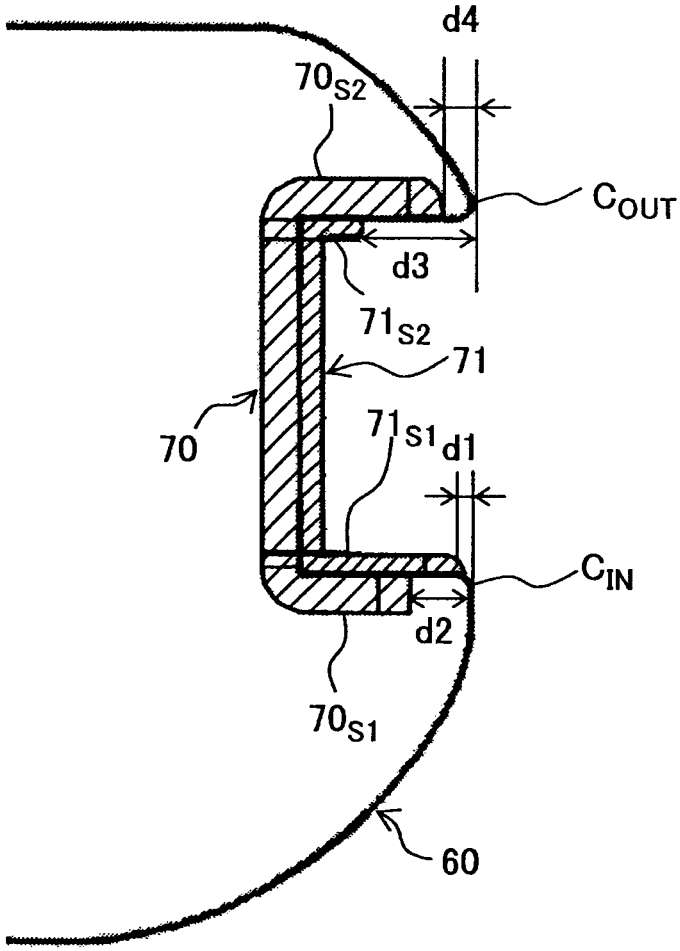
FIG. 16 is a cross-sectional diagram which shows a second part of how the internal holding member and the external holding member are installed in the supporting member at the nip concave portion.

Moreover, when using the groove-shaped internal holding member 71 and the groove-shaped external holding member 70 as described above and as shown in FIG. 16, it is preferable that the distance d1 from the corner portion $C_{IN}$ at which the side wall 67 of the nip concave portion 61 and the outer peripheral face of the supporting member 60 on the nip portion inlet side of the supporting member 60 cross to the tip of the sleeve portion $\mathbf{71}_{S1}$ of the internal holding member 71 is shorter than the distance d2 from the corner portion $C_{IN}$ to the tip of the sleeve portion $\mathbf{70}_{S1}$ of the external holding member 70.

In this way, deforming of the corner portion $C_{IN}$ may be prevented while suppressing increase of cost and heat capacity (consumed power) on the nip portion inlet side of the supporting member 60.

Since it is possible that the corner portion $C_{IN}$ of the supporting member 60 deforms in a direction which is opposite to the direction of rotation of the fixing belt 21 due to pressing of the fixing belt 21 on the nip portion inlet side, it is more preferable for the external holding member 70 to have a cross section having the sleeve portion $\mathbf{70}_{S1}$ to have a U-shaped groove shape than to have a L-shaped angle shape.

Moreover, when using the groove-shaped internal holding member 71 and the groove-shaped external holding member 70 as described above, as shown in FIG. 16, it is preferable that the distance d4 from the corner portion $C_{OUT}$ at which the side wall 67 of the nip concave portion 61 and the outer peripheral face of the supporting member 60 on the nip portion outlet side of the supporting member 60 cross to the tip of the sleeve portion $\mathbf{70}_{S2}$ of the external holding member 70 is shorter than the distance d3 from the corner portion $C_{OUT}$ to the tip of the sleeve portion $\mathbf{71}_{S2}$ of the internal holding member 70.

In this way, deforming of the corner portion $C_{OUT}$ may be prevented while suppressing increase of cost and heat capacity (consumed power) on the nip portion outlet side of the supporting member 60.

Since it is possible that the corner portion $C_{OUT}$ of the supporting member 60 deforms in a direction which is opposite the direction of rotation of the fixing belt 21 due to pressing of the fixing belt 21 on the nip portion inlet side, it is more preferable for the internal holding member 71 to have a cross section having the sleeve portion $\mathbf{71}_{S2}$ to have a U-shaped groove shape than to have an L-shaped angle shape.

Moreover, the support member 60 is molded to a C type pipe shape having the nip concave portion 61 by bending a stainless plate with a plate thickness of approximately 0.1 mm, the opening 69 of the nip concave portion 61 tends to open due to springing back of the plate material. In the present invention, a groove-shaped internal holding member 71 and a groove-shaped external holding member 70 may be used as a deform preventing unit to prevent deforming due to springing back to maintain proper shape of the nip concave portion 61.

Moreover, the groove-shaped internal holding member 71 and the groove-shaped external holding member 70 in the deform preventing member have different lengths for each of the sleeve portions as described above, direction of mounting in the direction of rotation of the fixing belt 21 when mounting to the supporting member 60 becomes important. Thus, it is preferable for the groove-shaped internal holding member 71 and the groove-shaped external holding member 70 to have a reverse-mounting preventing unit which prevents the direction of mounting on the supporting member 60 in the direction of rotation of the fixing belt 21 being in the reverse direction. The specific configurations are explained with reference to FIGS. 17 and 18.

Figure 17A:
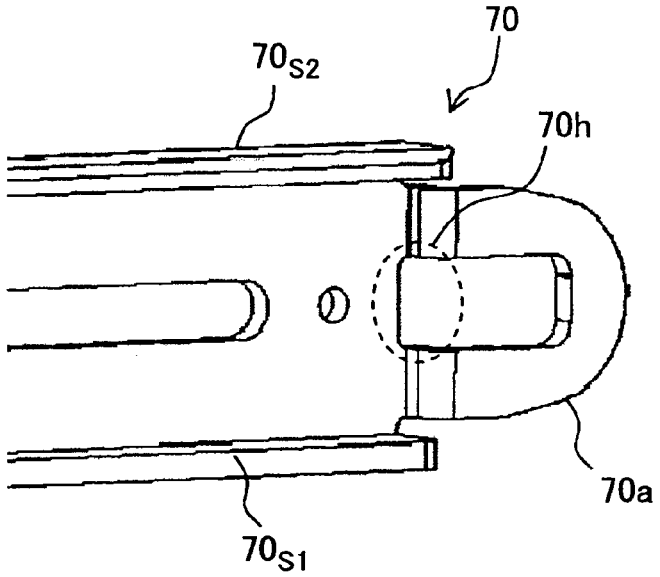
FIGS. 17A, 17B, and 17C are perspective views showing the feature of one end portion in an axial direction of the external holding member and the internal holding member.
Figure 17B:
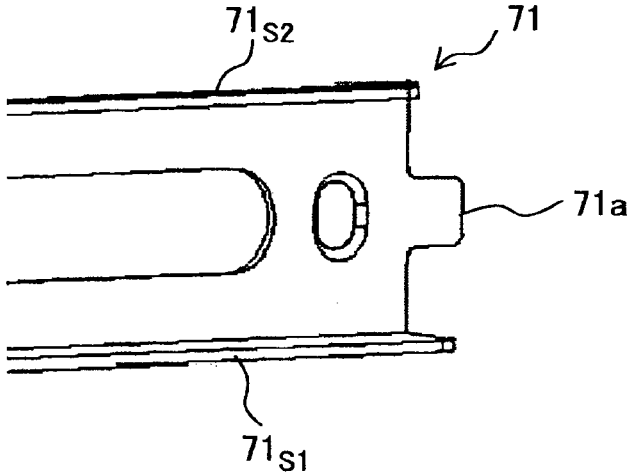
Figure 17C:
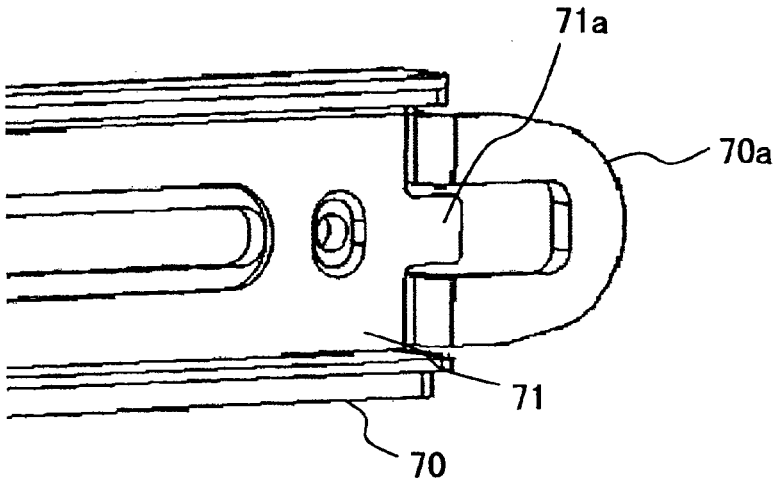

FIGS. 17A and 17B are perspective diagrams showing a configuration of one end portion in the axial direction (longitudinal direction) of the groove-shaped external holding member 70 and the grooved-shaped internal holding member 71. Of these, FIG. 17A shows a configuration of an end of the external holding member 70, FIG. 17B shows a configuration of an end of the internal holding member 71, and FIG. 17C shows a configuration of an end at which the internal holding member 71 is fitted into the external holding member 70.

First, the external holding member 70 includes, at each end in the axial direction thereof as a mounting portion 70*a* which is fixed to the supporting member 60 by the flange member 28, a portion which is bent in a step shape in the outside circumferential direction of the supporting member 60, but, only at the one end side, as shown in FIG. 17A, a square hole 70*h* is provided in the mounting portion 70*a* at the step-bent portion thereof.

Moreover, as shown in FIG. 17B, the internal holding member 71 includes a convex portion 71 at only one of the ends in the axial direction thereof, the convex portion 71 projecting in the axial direction. The convex portion 71*a* at the internal holding member 71 can be fitted into the square hole 70*h* of the external holding member 70 as shown in FIG. 17C.

Figure 18:
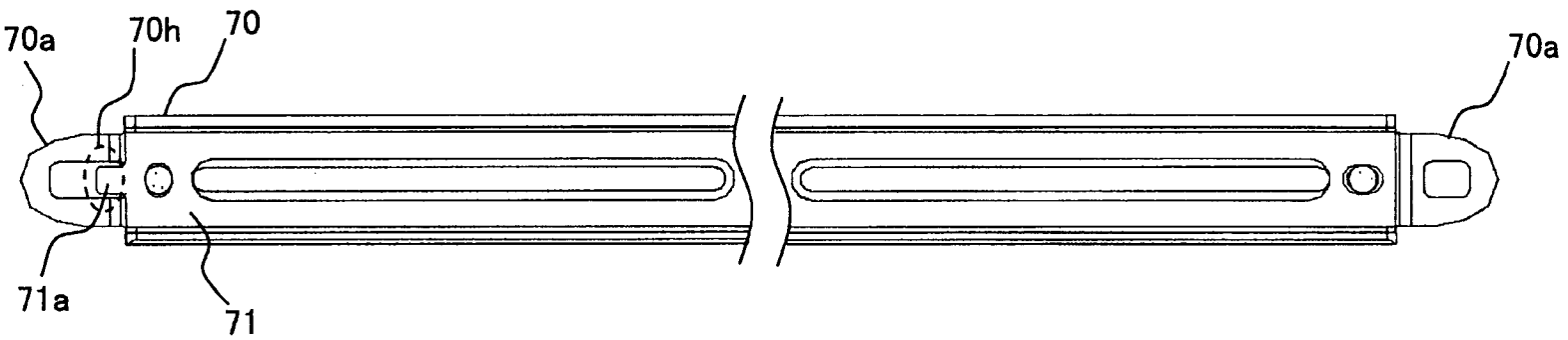
FIG. 18 is a top view which indicates how the external holding member and the internal holding member are fitted into each other.
Figure 19:
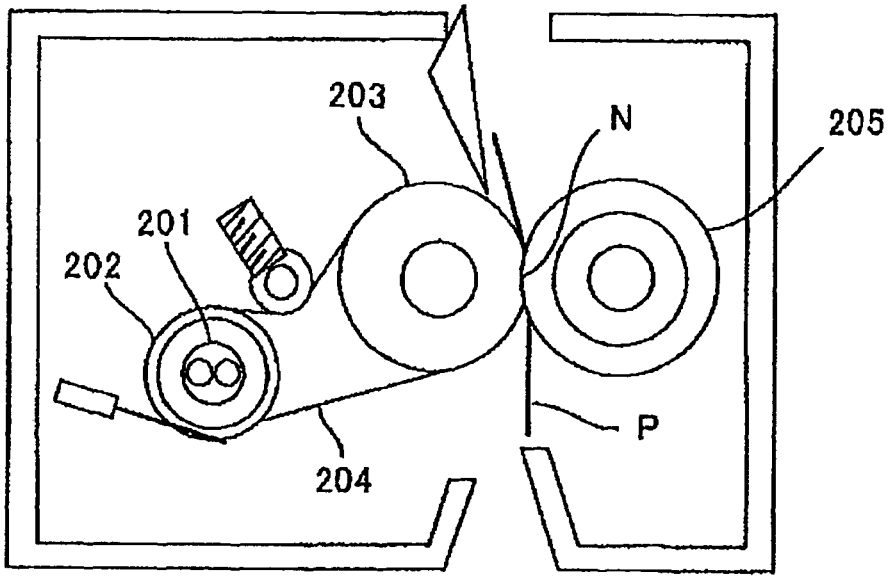
FIG. 19 is a schematic configuration diagram which shows a fixing apparatus of a related-art belt fixing scheme.
Figure 20:
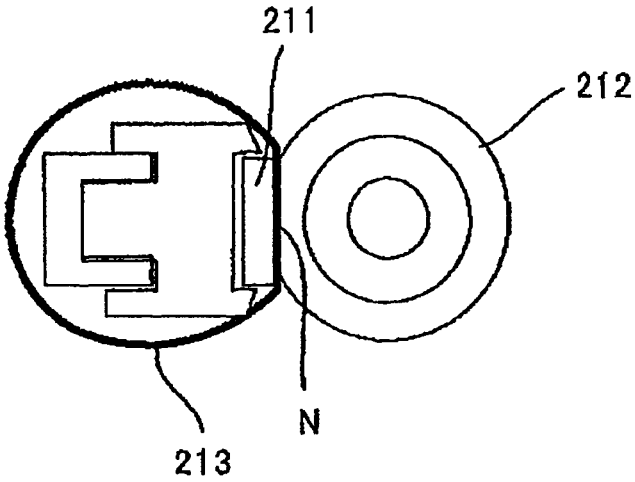
FIG. 20 is a schematic configuration diagram which shows a fixing apparatus of a related-art film heating scheme.

Here, as shown in FIG. 18, in the external holding member 70, the square hole 70*h* is provided at one end (shown on the left side) in the axial direction thereof and is not provided at the other end (shown on the right side). Thus, the convex portion 71*a*, which is provided at only one end in the axial direction of the internal holding member 71 may be fitted into only the mounting portion 70*a* on the one end side in the axial direction of the external holding member 70, so that a combination of sleeve portions of the internal holding member 71 and the external holding portion 70 may be arranged to be a proper one, i.e., a combination of the sleeve portions $\mathbf{70}_{S1}$ and $\mathbf{71}_{S1}$ at the one end side in the direction of rotation of the fixing belt 21 and a combination of the sleeve portion $\mathbf{70}_{S2}$ and the sleeve portion $\mathbf{71}_{S2}$ at the other end side, making it possible to prevent the direction of mounting to the supporting member 60 in the direction of rotation of the fixing belt 21 from becoming the reverse direction.

The present invention has been described with the embodiments shown in the drawings. However, the present invention is not limited to those embodiments shown therein. Thus, modifications may be made thereto within the scope a skilled person would have arrived at, such as other embodiments, additions, changes, deletions, etc., and are to be included in the scope of the present invention in any of the modes thereof as long as they achieve the operation and advantages of the present invention.

The present application is based on and claims the benefit of priority of Japanese Patent Application No. 2010-278149 filed on Dec. 14, 2010.

The invention claimed is:

1. A fixing apparatus, comprising:

a fixing member for a rotatable endless belt;

a pressurizing member arranged to be abuttable against the fixing member on an outer peripheral side of the fixing member;

a supporting member that is a C type pipe member and includes a concave portion with an opening thereof arranged to be a bottom face side, the C type pipe member being fixedly provided inside the fixing member and an outer peripheral face of the C type pipe member being in slidable contact with an inner peripheral face of the fixing member;

a heating unit that heats the supporting member;

a nip forming member that is contained in the concave portion of the supporting member on an inner peripheral side of the fixing member and abuts against the pressurizing member via the fixing member to form a nip portion; and a deform preventing unit which reinforces the concave portion to prevent deforming of the supporting member due to sliding of the fixing member, wherein the deform preventing unit includes an internal holding member which has an L-shaped angle shape or a groove shape with a cross section that is U-shaped and includes sleeve portions having different lengths, the internal holding member being installed from an outer peripheral side of the supporting member to inside the concave portion.

2. The fixing apparatus as claimed in claim 1, wherein when the internal holding member has the groove shape, an outer face of a longer one of the sleeve portions is abutted against a side wall on a nip portion inlet side of the concave portion, and wherein when the internal holding member has the angle shape, an outer side of one of bent faces is abutted against the side wall on the nip portion inlet side of the concave portion.

3. The fixing apparatus as claimed in claim 2, wherein the deform preventing unit includes an external holding member which has an L-shaped angle shape or a groove shape with a cross section that is U-shaped and includes sleeve portions having different lengths, the external holding member being installed from an inner peripheral side of the supporting member to outside the concave portion, wherein when the external holding member has the groove shape, an inner face of a longer one of the sleeve portions is abutted against a side wall on a nip portion outlet side of the concave portion, and wherein when the external holding member has the angle shape, an inner side of one of bent faces is abutted against the side wall on the nip portion outlet side of the concave portion.

4. The fixing apparatus as claimed in claim 3, wherein the deform preventing unit includes the groove-shaped internal holding member and the groove-shaped external holding member, and wherein a distance from a corner portion, at which an outer peripheral face of the supporting member on a nip portion inlet side of the supporting member and a side wall of the concave portion cross, to a tip of a respective sleeve portion is shorter for the internal holding member than for the external holding member.

5. The fixing apparatus as claimed in claim 4, wherein a distance from a corner portion, at which an outer peripheral face of the supporting member on a nip portion outlet side of the supporting member and a side wall of the concave portion cross, to a tip of an other respective sleeve portion is shorter for the external holding member than for the internal holding member.

6. The fixing apparatus as claimed in claim 4, wherein the internal holding member and the external holding member include a reverse mounting preventing unit which prevents a direction of mounting of the holding members in a direction of rotation of the fixing member from being a reverse direction.

7. The fixing apparatus as claimed in claim 5, wherein the internal holding member and the external holding member include a reverse mounting preventing unit which prevents a direction of mounting of the holding members in a direction of rotation of the fixing member from being a reverse direction.

8. The fixing apparatus as claimed in claim 3, wherein the deform preventing unit includes the groove-shaped internal holding member and the groove-shaped external holding member, and wherein a distance from a corner portion, at which an outer peripheral face of the supporting member on a nip portion outlet side of the supporting member and a side wall of the concave portion cross, to a tip of a respective sleeve portion is shorter for the external holding member than for the internal holding member.

9. The fixing apparatus as claimed in claim 8, wherein the internal holding member and the external holding member include a reverse mounting preventing unit which prevents a direction of mounting of the holding members in a direction of rotation of the fixing member from being a reverse direction.

10. An image forming apparatus, comprising the fixing apparatus as claimed in claim 1.

11. A fixing apparatus, comprising:

a fixing member for a rotatable endless belt;

a pressurizing member arranged to be abuttable against the fixing member on an outer peripheral side of the fixing member;

a supporting member that is a C type pipe member and includes a concave portion with an opening thereof arranged to be a bottom face side, the C type pipe member being fixedly provided inside the fixing member and an outer peripheral face of the C type pipe member being in slidable contact with an inner peripheral face of the fixing member;

a heating unit that heats the supporting member;

a nip forming member that is contained in the concave portion of the supporting member on an inner peripheral side of the fixing member and abuts against the pressurizing member via the fixing member to form a nip portion; and a deform preventing unit which reinforces the concave portion to prevent deforming of the supporting member due to sliding of the fixing member, wherein the deform preventing unit includes an external holding member which has an L-shaped angle shape or a groove shape with a cross section that is U-shaped and includes sleeve portions having different lengths, the external holding member being installed from an inner peripheral side of the supporting member to outside the concave portion.

12. The fixing apparatus as claimed in claim 11, wherein the deform preventing unit includes a groove-shaped internal holding member and the groove-shaped external holding member, and wherein a distance from a corner portion, at which an outer peripheral face of the supporting member on a nip portion inlet side of the supporting member and a side wall of the concave portion cross, to a tip of a respective sleeve portion is shorter for the internal holding member than for the external holding member.

13. The fixing apparatus as claimed in claim 12, a distance from a corner portion, at which an outer peripheral face of the supporting member on a nip portion outlet side of the supporting member and a side wall of the concave portion cross, to a tip of an other respective sleeve portion is shorter for the external holding member than for the internal holding member.

14. The fixing apparatus as claimed in claim 12, wherein the internal holding member and the external holding member include a reverse mounting preventing unit which prevents a direction of mounting of the holding members in a direction of rotation of the fixing member from being a reverse direction.

15. The fixing apparatus as claimed in claim 13, wherein the internal holding member and the external holding member include a reverse mounting preventing unit which prevents a direction of mounting of the holding members in a direction of rotation of the fixing member from being a reverse direction.

16. The fixing apparatus as claimed in claim 11, wherein the deform preventing unit includes a groove-shaped internal holding member and the groove-shaped external holding member, and wherein a distance from a corner portion, at which an outer peripheral face of the supporting member on a nip portion outlet side of the supporting member and a side wall of the concave portion cross, to a tip of a respective sleeve portion is shorter for the external holding member than for the internal holding member.

17. The fixing apparatus as claimed in claim 16, wherein the internal holding member and the external holding member include a reverse mounting preventing unit which prevents a direction of mounting of the holding members in a direction of rotation of the fixing member from being a reverse direction.

18. The fixing apparatus as claimed in claim 11, wherein when the external holding member has the groove shape, an inner face of a longer one of the sleeve portions is abutted against a side wall on a nip portion outlet side of the concave portion, and wherein when the external holding member has the angle shape, an inner side of one of bent faces is abutted against the side wall on the nip portion outlet side of the concave portion.

19. A fixing apparatus, comprising:

a fixing member for a rotatable endless belt;

a pressurizing member arranged to be abuttable against the fixing member on an outer peripheral side of the fixing member;

a supporting member including a C type pipe member with an outer peripheral face in slidable contact with an inner peripheral face of the fixing member, and a concave portion including a bottom wall and an opening arranged to be on a bottom face side of the concave portion;

a heating unit that heats the supporting member;

a nip forming member positioned in the concave portion on an inner peripheral side of the fixing member and abuts against the pressurizing member via the fixing member to form a nip portion; and a deform preventing unit including a first sleeve and a second sleeve extending in a direction from the supporting member towards the inner peripheral side of the fixing member;

wherein the deform preventing unit reinforces the concave portion to prevent deforming of the supporting member due to sliding of the fixing member, and wherein the first sleeve extends in the direction a first length relative to the bottom wall and the second sleeve extends in the direction a second length relative to the bottom wall that is different than the first length.

20. The fixing apparatus as claimed in claim 19, wherein a distance between a tip of one of the first sleeve and the second sleeve and a corner portion formed by a first side wall of the concave portion and an outer peripheral face of the supporting member on a nip portion inlet side of the supporting member is less than a distance between a tip of the other of the first sleeve and the second sleeve and a corner portion formed by a second side wall of the concave portion and an outer peripheral face of the supporting member on a nip portion outlet side of the supporting member.

21. The fixing apparatus as claimed in claim 19, wherein a distance between a tip of one of the first sleeve and the second sleeve and a corner portion formed by a first side wall of the concave portion and an outer peripheral face of the supporting member on a nip portion inlet side of the supporting member is greater than a distance between a tip of the other of the first sleeve and the second sleeve and a corner portion formed by a second side wall of the concave portion and an outer peripheral face of the supporting member on a nip portion outlet side of the supporting member.

* * * * *